US008910317B2

(12) United States Patent
Decker

(10) Patent No.: US 8,910,317 B2
(45) Date of Patent: Dec. 16, 2014

(54) SHIRTS AND SHORTS HAVING ELASTIC AND NON-STRETCH PORTIONS AND BANDS TO PROVIDE HIP AND POSTURE SUPPORT

(71) Applicant: Opedix, LLC, Scottsdale, AZ (US)

(72) Inventor: Michael John Decker, Highlands Ranch, CO (US)

(73) Assignee: Opedix, LLC, Scottsdale, AZ (US)

( * ) Notice: Subject to any disclaimer, the term of this patent is extended or adjusted under 35 U.S.C. 154(b) by 0 days.

(21) Appl. No.: 13/731,830

(22) Filed: Dec. 31, 2012

(65) Prior Publication Data

US 2013/0167285 A1 Jul. 4, 2013

Related U.S. Application Data

(60) Provisional application No. 61/582,042, filed on Dec. 30, 2011.

(51) Int. Cl.
*A41D 1/06* (2006.01)

(52) U.S. Cl.
USPC ..... 2/227; 2/69; 602/19; 482/124; 450/100

(58) Field of Classification Search
CPC ..... A41D 2400/38; A41D 2400/32; A41D 2400/322; A41D 1/08; A41C 1/003
USPC ..... 2/69, 227, 44, 45, 114, 115, 102, 104, 2/69.5, 79, 2.11, 459, 461, 467, 92, 125, 2/133, 34, 242, 239, 241, 78.3; 602/19, 602/20, 4, 61; 482/124; 450/100
See application file for complete search history.

(56) References Cited

U.S. PATENT DOCUMENTS

| | | | | |
|---|---|---|---|---|
| 1,722,192 | A | 7/1929 | Brokaw | |
| 1,939,257 | A | 12/1933 | Erlanger | |
| 3,395,712 | A | 8/1968 | Laguzzi | |
| 3,663,797 | A | 5/1972 | Marsh | |
| 4,862,523 | A * | 9/1989 | Lipov | 2/409 |
| 4,926,845 | A | 5/1990 | Harris | |
| 5,201,074 | A * | 4/1993 | Dicker | 2/70 |
| 5,306,229 | A | 4/1994 | Brandt et al. | |
| 5,344,384 | A | 9/1994 | Ostrow et al. | |
| 5,465,428 | A | 11/1995 | Earl | |
| 5,555,566 | A | 9/1996 | Kuhn | |
| 5,857,990 | A | 1/1999 | Maas | |
| 5,937,442 | A | 8/1999 | Yamaguchi et al. | |
| 6,176,816 | B1 | 1/2001 | Dicker et al. | |
| 6,231,488 | B1 * | 5/2001 | Dicker et al. | 482/124 |
| 6,306,111 | B1 | 10/2001 | Dean | |

(Continued)

OTHER PUBLICATIONS

Bennet, Henry, "International Search Report re Application No. PCT/US05/07679", Feb. 22, 2007, p. 1 Published in: US.

(Continued)

*Primary Examiner* — Khoa Huynh
*Assistant Examiner* — Khaled Annis
(74) *Attorney, Agent, or Firm* — Neugeboren O'Dowd PC

(57) ABSTRACT

This disclosure describes systems, methods, and apparatus for garments that restrict detrimental or abnormal movement of the upper and lower body. This is made possible by forming garments from an elastic base layer and then coupling one or more elastic and/or inelastic bands coupled to, secured to, or atop the base material in locations that restrict detrimental movement of the body. A load distribution ring can anchor some of the bands.

23 Claims, 16 Drawing Sheets

(56) References Cited

U.S. PATENT DOCUMENTS

| | | | | |
|---|---|---|---|---|
| 6,440,094 | B1 | 8/2002 | Maas | |
| 6,464,656 | B1 | 10/2002 | Salvucci et al. | |
| 6,936,021 | B1 | 8/2005 | Smith | |
| 6,945,945 | B2 | 9/2005 | Givler et al. | |
| 7,037,284 | B2 | 5/2006 | Lee | |
| 7,087,032 | B1 * | 8/2006 | Ikeda | 602/19 |
| 7,871,388 | B2 | 1/2011 | Brown | |
| 2002/0143373 | A1 | 10/2002 | Courtnage et al. | |
| 2003/0028952 | A1 * | 2/2003 | Fujii et al. | 2/400 |
| 2004/0133959 | A1 | 7/2004 | Horii et al. | |
| 2006/0253960 | A1 * | 11/2006 | Horn et al. | 2/227 |
| 2007/0214541 | A1 * | 9/2007 | Kawasaki et al. | 2/69 |
| 2008/0208089 | A1 | 8/2008 | Newkirk et al. | |
| 2009/0062704 | A1 | 3/2009 | Brown et al. | |
| 2010/0088803 | A1 | 4/2010 | Orloff | |
| 2010/0205713 | A1 | 8/2010 | Takamoto et al. | |

OTHER PUBLICATIONS

Young, Lee W., "International Search Report and Written Opinion re Application No. PCT/US12/72227", Apr. 26, 2013, p. 13, Published in: WO.

Bolgla, et al, "Hip Strength and Hip and Knee Kinematics During Stair Descent in Females With and Without Patellofemoral Pain Syndrome", Jan. 2008, pp. 7, vol. 38, No. 1, Publisher: Journal of Orthopedic & Sports Physical Therapy, Published in: US.

Boling, et al., "Outcomes of a Weight-Bearing Rehabilitation Program for Patients Diagnosed With Patellofemoral Pain Syndrome", Nov. 2006, p. 8 vol. 87, Publisher: Arc Phys Med Rehabil, Published in: US.

Borstad, John D, "Resting Position Variables at the Shoulder: Evidence to Support a Posture-Impairment Association", Apr. 2006, p. 11 vol. 86, No. 4, Publisher: Physical Therapy Journal, Published in: US.

Cichanowski, et al., "Hip Strength in Collegiate Female Athletes with Patellofemoral Pain", 2007, p. 6 vol. 39, No. 8, Publisher: American College of Sports Medicine, Published in: US.

Dostal, et al., "Actions of Hip Muscles", Mar. 1986, p. 11 vol. 66, No. 3, Publisher: Physical Therapy Journal, Published in: US.

Ferber, et al., "Gender Differences in Lower Extremity Mechanics During Running", 2002, p. 8 Publisher: Elsevier Science Ltd., Published in: US.

Fredericson, et al., "Hip Abductor Weakness in Distance Runners with Iliotibial Band Syndrome", "Clinical Journal of Sport Medicine", 2000, p. 7 Publisher: Lippincott Williams & Wilkins, Inc. , Published in: US.

Fredericson, et al., "Muscular Balance, Core Stability, and Injury Prevention for Middle- and Long-Distance Runners", 2005, p. 21 Publisher: Elsevier, Inc., Published in: US.

Gottschalk, et al., "The Functional Anatomy of Tensor Fasciae Latae and Gluteus Medius and Minimus", Feb. 1989, p. 11 vol. 166, Publisher: J. Anat. , Published in: US.

Greenfield, et al., "Posture in Patients With Shoulder Overuse Injuries and Healthy Individuals", May 1995, p. 9, vol. 21, No. 5, Publisher: Journal of Orthopaedic & Sports Physical Therapy, Published in: US.

Hreljac, et al., "Evaluation of Lower Extremity Overuse Injury Potential in Runners", 2000, p. 7, vol. 32, No. 9, Publisher: Med. Sci. Sports Exerc., Published in: US.

Ireland, et al., "Hip Strength in Females With and Without Patellofemoral Pain", 2000, p. 6 Publisher: Journal of Orthpaedic & Sports Physical Therapy, Published in: US.

James, et al., "Injuries to Runners", 1978, p. 11 vol. 6, No. 2, Publisher: American Orthopaedic Society for Sports Medicine, Published in: US.

Kibler, et al., "The Role of Core Stability in Athletic Function", 2006, p. 11 vol. 36, No. 3, Publisher: Sports Med., Published in: US.

Leetun, et al., "Core Stability Measure as Risk Factors for Lower Extremity Injury in Athletes", 2004, p. 9 vol. 36, No. 6, Publisher: Med. Sci. Sports Exerc. , Published in: US.

Lephart, et al., "An Eight-Week Golf-Specific Exercise Program Improves Physical Characteristics, Swing Mechanics, and Golf Performance in Recreational Golfers", 2007, p. 10 vol. 21, No. 3, Publisher: Journal of Strength and Conditioning Research, Published in: US.

Lundberg, et al., "Kinematics of the Ankle/Foot Complex—Part 2: Pronation and Supination", 1989, p. 6 Publisher: American Orthopaedic Foot and Ankle Society, Inc., Published in: US.

Macera, et al., "Predicting Lower-Extremity Injuries Among Habitual Runners", 1989, pp. 4, Publisher: Arch Intern Med., Published in: US.

Mann, et al., "Comparative Electromyography of the Lower Extremity in Jogging, Running, and Sprinting", 1986, p. 10 vol. 14, No. 6, Publisher: The American Journal of Sports Medicine , Published in: US.

Marti, et al., "On the Epidemiology of Running Injuries", 1988, pp. 10 vol. 16, No. 3, Publisher: The American Journal of Sports Medicine, Published in: US.

Mascal, et al., "Management of Patellofemoral Pain Targeting Hip, Pelvis, and Trunk Muscle Function: 2 Case Reports", 2003, p. 14 Publisher: Journal of Orthopaedic & Sports Physical Therapy, Published in: US.

Nakagawa, et al., "Generation of Induced Pluripotent Stem Cells without Myc from Mouse and Human Fibroblasts", 2008, p. 6 Publisher: Nature Biotechnology, Published in: US.

Nelson-Wong, et al., "Gluteus Medius Muscle Activation Patterns as a Predictor of Low Back Pain during Standing", 2008, p. 9 Publisher: Elsevier Ltd., Published in: US.

Niemuth, et al., "Hip Muscle Weakness and Overuse Injuries in Recreational Runners", 2005, p. 8 vol. 15, No. 1, Publisher: Lippincott Williams & Wilkins, Published in: US.

Reiman, et al., "Hip Function's Influence on Knee Dysfunction: A Proximal Link to a Distal Problem", 2009, p. 15 Publisher: Journal of Sport Rehabilitation, Published in: US.

Souza, et al., "Differences in Hip Kinematics, Muscle Strength, and Muscle Activation Between Subjects With and Without Patellofemoral Pain", 2009, p. 8 vol. 39, No. 1, Publisher: Journal of Orthopaedic & Sports Physical Therapy, Published in: US.

Souza, et al., "Predictors of Hip Internal Rotation During Running", 2009, p. 9 vol. 37, No. 3, Publisher: The American Journal of Sports Medicine, Published in: US.

Taunton, et al., "A Retrospective Case-Control Analysis of 2002 Running Injuries", 2002, p. 8 Publisher: Br J Sports Med, Published in: US.

Ward, et al., "Are Current Measurements of Lower Extremity Muscle Architecture Accurate?", 2009, vol. 467, No. 4, Publisher: Clin Orthop Relat Res, Published in: US.

Willson, et al., "Core Stability and Its Relationship to Lower Extremity Function and Injury", 2005, p. 10 vol. 13, No. 5, Publisher: Journal of the American Academy of Orthopaedic Surgeons, Published in: US.

Yeung, et al., "A Systematic Review of Interventions to Prevent Lower Limb Soft Tissue Running Injuries", 2001, p. 8 Publisher: Br J Sports Med, Published in: US.

* cited by examiner

SHIRTS AND SHORTS HAVING ELASTIC AND NON-STRETCH PORTIONS AND BANDS TO PROVIDE HIP AND POSTURE SUPPORT

CLAIM OF PRIORITY UNDER 35 U.S.C. §119

The present Application for Patent claims priority to Provisional Application No. 61/582,042 entitled "SHIRTS AND SHORTS HAVING ELASTIC AND NON-STRETCH PORTIONS AND BANDS TO PROVIDE HIP AND POSTURE SUPPORT" filed Dec. 30, 2011, and assigned to the assignee hereof and hereby expressly incorporated by reference herein.

FIELD OF THE INVENTION

The present disclosure relates generally to injury prevention and recovery. In particular, but not by way of limitation, the present disclosure relates to systems, methods and apparatus for garments that supports static and dynamic body alignment to prevent or compensate for weakening, fatigued or injured muscles.

BACKGROUND

The sport of running is a popular fitness activity, with an estimated 30 million Americans classified as recreational runners (Austin, 2002). The overall incidence of lower extremity injuries in runners that run ≥5 km per training day or race has been found to range between 19.4% and 79.3% (van Gent et al., 2007). The predominant joint injured is the knee (7.2% to 50.0%) followed by the ankle (3.9% to 16.6%) and hip (3.3% to 11.5%). Overuse injuries are the majority of all musculoskeletal running injuries stemming from training errors, anatomical or biomechanical factors (Hreljac et al., 2000; James et al., 1978; Macera et al., 1989).

Core stability has been defined as the lumbo-pelvic hip muscle strength and endurance yielding a coordinated activation of muscles and maintenance of alignment throughout the kinetic chain (Fredericson et al. (2005); Kibler et al. (2006); Leetun et al. (2004); Willson et al. (2005)). The stance phase of running is a closed kinetic chain activity requiring proximal stability to balance and support the weight of the upper body. When core instability exists, due to strength and/or endurance deficits, the body may not be optimally aligned to absorb and produce large ground reaction forces, which in turn could place the runner at an increased risk for lower extremity injury (Ferber et al., 2002; Marti et al., 1988). Frontal plane pelvic drop is one sign of core instability that could be identified as a weak link in the running kinetic chain. Pelvic drop in the frontal plane, termed 'Trendelenburg gait,' is visualized when there is a downward obliquity from the hip of the stance leg towards the opposite hip during its swing phase.

Core instability as demonstrated by frontal plane pelvic drop is due to strength and endurance issues of the gluteus medius muscle (Mann et al., 1986). The gluteus medius is one of the strongest lower extremity muscles (Ward, Eng, Smallwood, & Lieber, 2009) and is made up of three parts of nearly equal volume with three distinct muscle fiber directions and separate innervations (Dostal, Soderberg, & Andrews, 1986; Gottschalk, Kourosh, & Leveau, 1989). This muscle originates on the dorsal ilium below the iliac crest and inserts at the top outside surfaces of the greater trochanter. Based on its anatomical location, cross sectional area and architecture, the gluteus medius muscle is critical to the functions of the lower back (Nelson-Wong, Gregory, Winter, & Callaghan, 2008), hip (Bolgla & Uhl, 2005; Delp et al., 1999), knee (Boling, Bolgla, Mattacola, Uhl, & Hosey, 2006; Mascal, Landel, & Powers, 2003; Nakagawa et al., 2008) and the ankle. Hence, core instability due to gluteus medius muscle weakness will lead to abnormal spinal and lower extremity kinematics during running.

The gait adaptations due to a weak or fatigued gluteus medius muscle during running and the anatomical areas at risk of structural overload are summarized in Table 1 (Bolgla & Uhl, 2005; Boling, Bolgla, Mattacola, Uhl, & Hosey, 2006; Cichanowski et al., 2007; Fredericson et al., 2000; Ireland et al., 2003; Leetun et al., 2004; Mascal, Landel, & Powers, 2003; Nakagawa et al., 2008; Nelson-Wong, Gregory, Winter, & Callaghan, 2008; Niemuth et al., 2005; Presswood et al., 2008; Reiman et al., 2009; Souza et al., 2009). Individual running techniques may demonstrate combinations of the adaptations below but clearly not simultaneous medial and lateral knee drift. Further, the gait adaptations may also occur during walking visualized as a waddling motion or a limp.

Table 1 shows gait adaptations due to a weak gluteus medius muscle during running.

| Gait adaptations | Areas at risk of structural overload |
|---|---|
| Trendelenburg gait | Lumbar spine, sacroiliac joint (SIJ), greater trochanter bursa, insertion of muscle on greater trochanter, overactivity of piriformis and tensor fascia lata (TFL) |
| Medial knee drift (valgus position of tibiofemoral joint) | Lateral tibiofemoral compartment (via compression), patellofemoral joint, patella tendon and fat pad, pes anserinus, iliotibial band (ITB), anterior cruciate ligament strain (ACL) |
| Lateral knee drift (varus position of tibiofemoral joint) | Medial tibiofemoral compartment (via compression), ITB, posterolateral knee soft tissues (via tension), popliteus |
| Same sided shift of trunk (lateral flexion of trunk) | Lumbar spine (increased disc and facet joint compression), SIJ (increased shear) |

The most commonly diagnosed lower limb soft tissue injuries caused by distance running are iliotibial band syndrome, tibial stress syndrome, patellofemoral pain syndrome, Achilles tendonitis and plantar fasciitis (Yeung & Yeung 2001). From the table above, a common adaptation from weakness of the gluteus medius muscle during the stance phase of running occurs when the femur excessively adducts or internally rotates. These motions increases the tension on the iliotibial band (Taunton et al., 2002) and cause abnormal patellofemoral contact stress (Souza & Powers, 2009). Continuing down the kinetic chain, internal rotation of the femur also allows the knee to fall into a valgus position and promotes the tibia to rotate internally relative to the foot and increases the weight transfer to the medial aspect of the foot. These motions increase the risk of any condition relating to excessive and/or prolonged pronation of the foot such as tibial stress syndrome and Achilles tendonitis (Lundberg et al., 1989). Further, the combination motions of ankle pronation and knee valgus are implicated as the primary mechanism of non-contact ACL injury in sports where running is an integral component (Souza & Powers, 2009).

In addition, poor lumbo-pelvic posture due to abnormal sagittal plane or frontal plane pelvic rotations leads to compensation in the thoracic spinal posture and subsequent shoulder dyskinesis (Borstad, 2006; Greenfield et al., 1995). Poor thoracic posture relates to an increased forward curve of the thoracic region of the spine (kyphosis) and produces a 'hunching' or 'hump back' appearance and a rounding of the shoulders. The rounding of the upper back and shoulders cause the head and neck to tilt downward thus to look straight ahead requires the head to be lifted upward and forward. This forward head posture causes several clinical symptoms and also the continuation of many clinical issues including headaches, pain between the shoulder blades, upper back pain, neck pain, numbness and tingling of the fingers and shoulder pain. Pain originating from the shoulder could also radiate into the neck, head, arm, or chest.

Respiratory dysfunction is also caused from an excessive rounding of the shoulders which is a sequence of abnormal kinematic events of the scapula, clavicle and humerus. First, thoracic kyphosis causes abnormal three-dimensional scapular kinematics including scapular protraction, downward rotation and anterior tilting. The humerus articulates with the scapula at the glenohumeral joint and abnormal scapular kinematics causes the humerus to shift down and rotate inwards toward the center of the body. The scapula also articulates with the clavicle at the acromioclavicular joint hence abnormal scapular and humeral kinematics causes abnormal clavicular kinematics, namely clavicular protraction, and increases force transmission of the proximal portion of the clavicle on the first rib at the sternoclavicular joint. The increased force transmission at this joint in combination with thoracic kyphosis limits the ability of the ribs to expand during respiration and the respiratory muscles to properly function thus reducing lung volume and blood oxygenation.

Collectively, core strength imbalances stemming from weakness of the gluteus medius muscle may be associated with or predispose an individual to injury. Successful preventative strategies for the knee during running include modifying training schedules or external body support (i.e., patellar knee brace, footwear, lumbar brace) (Yeung & Yeung, 2009). However, it has been shown that gluteus medius muscle strengthening exercises reduces the magnitude of frontal plane pelvic drop (Presswood et al., 2008), improves performance (Lephart et al., 2007) and reduces clinical symptoms in the soft tissues of the hip (Bolgla & Uhl, 2005), knee (Boling, Bolgla, Mattacola, Uhl, & Hosey, 2006; Mascal, Landel, & Powers, 2003; Nakagawa et al., 2008) and lumbar area (Nelson-Wong, Gregory, Winter, & Callaghan, 2008). Further, strength and kinematic improvements in the lumbar area are related to improvements in the thoracic area and leads to beneficial changes in shoulder and respiratory function.

Various braces are known that can mitigate some of the above challenges. However, braces tend to be uncomfortable, heavy, and aesthetically displeasing, especially when worn for long periods of time (e.g., a full day on the ski slopes). As a result, braces are often not worn for as long as they could be and thus their beneficial effects are not fully felt. Further, braces are used to immobilize or compensate for a change in joint stability or angular position caused by muscular weakness or injury and are thought to promote atrophy of the muscles surrounding the joint leading to secondary clinical problems. There is therefore a need in the art for physiological support mechanisms that are lightweight, comfortable, and fashionable and that facilitate functional movement and muscular function of the kinetic chain.

SUMMARY OF THE INVENTION

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

Systems and methods are herein disclosed for garments made from multiple materials having different levels of elasticity (stretchiness) so as to provide external tensions in specific directions on the body and thereby reproduce the anatomical function of various muscles such as the gluteus medius. The garments can be worn separately or together as top layers, as an underlayer or liner for other garments, or as training/rehabilitation gear.

One aspect of the invention can be characterized as a garment configured to counteract frontal pelvic plane drop and internal rotation of the femur. The garment can include a base layer, a load distribution ring, a lateral elastic band, a first diagonal elastic band, a second diagonal elastic band, and a first inelastic band. The base layer can have a right leg portion and a left leg portion, the base layer having a first elasticity. The load distribution ring can be arranged proximate to a front waist portion of the garment and having a second elasticity that is less than the first elasticity. The lateral elastic band can wrap around the garment proximate to the waist portion of the garment and secured over the base layer. The lateral elastic band can be discontinuous and have two ends, the two ends can couple to the load distribution ring, and the lateral elastic band can have a third elasticity. The first diagonal elastic band can couple to and extend at an angle down and away from the load distribution ring on the right leg portion. The second diagonal elastic band can couple to and extending at an angle down and away from the load distribution ring on the left leg portion. The first inelastic band can overlap a portion of the lateral elastic band proximate to a rear waist portion of the garment. The first inelastic band can further intersect a bottom portion of each of the leg portions proximate to the front of the garment. The first inelastic band can have the second elasticity.

Another aspect of the disclosure can be described as a method of manufacturing a garment. The method can include a base layer from a first material having a first elasticity. The method can also include coupling a plurality of elastic bands atop the base layer, the plurality of elastic bands made from a second material having a second elasticity. The method can further include coupling a load distribution ring atop the base layer. The load distribution ring can be coupled to ends of two or more of the plurality of elastic bands. The inelastic load distribution ring can be made from a third material having a third elasticity less elastic than either the first or second elasticities. The method can further include coupling an inelastic band over portions of at least some of the plurality of elastic bands and coupling the inelastic band over portions of the base layer. The inelastic band can be made from the third material. The inelastic band can provide regions of the garment that do not stretch when the first and second materials are stretched.

Another aspect of the disclosure can be described as a shirt configured to counteract detrimental upper body movement. The shirt can include a base layer, a plurality of inelastic bands coupled to the base layer, and a load distribution ring coupled atop a middle of a back of the shirt. The load distribution ring can anchor ends of a first, second, third, and fourth ones of the plurality of inelastic bands.

Yet another aspect of the disclosure can be described as a method of manufacturing a shirt. The method can include forming a base layer having a first elasticity. The method can further include securing a plurality of inelastic bands over the base layer, the plurality of inelastic bands having a second elasticity less than the first elasticity. The method can further include securing a load distribution ring over the base layer and securing the load distribution ring to at least two of the plurality of inelastic bands. The load distribution ring can anchor the at least two of the plurality of inelastic bands to substantially a middle of a back of the shirt. The load distribution ring can have the second elasticity.

A further aspect of the disclosure can be described as a one-piece garment including an upper body portion and a lower body portion. The upper body portion can include a first base layer, a plurality of inelastic bands coupled to the first base layer, and a first load distribution ring coupled atop a middle of a back of the upper body portion, the first load distribution ring anchoring ends of first, second, third, and fourth ones of the plurality of inelastic bands. The load distribution ring can anchor ends of a first, second, third, and fourth ones of the plurality of inelastic bands. The lower body portion can include a second base layer, a second load distribution ring, a lateral elastic band, a first diagonal elastic band, a second diagonal elastic band, and a first inelastic band. The second base layer can have a right leg portion and a left leg portion, and the second base layer can have a first elasticity. The second load distribution ring can be arranged proximate to a front waist portion of the lower body portion and can have a second elasticity that is less than the first elasticity. The lateral elastic band can wrap around the lower body portion proximate to the waist portion of the lower body portion and can be secured over the base layer. The lateral elastic band can be discontinuous and have two ends, the two ends can couple to the second load distribution ring, and the lateral elastic band can have a third elasticity. The first diagonal elastic band can couple to and extend at an angle down and away from the second load distribution ring on the right leg portion. The second diagonal elastic band can couple to and extend at an angle down and away from the second load distribution ring on the left leg portion. The first inelastic band can overlap a portion of the lateral elastic band proximate to a rear waist portion of the lower body portion. The first inelastic band can further intersect a bottom portion of each of the leg portions proximate to the front of the lower body portion. The first inelastic band can have the second elasticity.

The first and second base layers of the one-piece garment may be the same material. The upper body portion and the lower body portion of the one-piece garment may be coupled via stitching at the waist. Further, in an embodiment, the upper body portion and the lower body portion of the one-piece garment can be the same base layer. In a further embodiment, the upper body portion can include first connecting mechanisms and the lower body portion can include second connecting mechanisms, and wherein the first and second connecting mechanisms can couple to each other. In this way, the first and second connecting mechanisms can temporarily secure the upper body portion to the lower body portion.

BRIEF DESCRIPTION OF THE DRAWINGS

Various objects and advantages and a more complete understanding of the present invention are apparent and more readily appreciated by referring to the following detailed description and to the appended claims when taken in conjunction with the accompanying drawings:

illustrates a front and back of a shirt according to one embodiment of this disclosure.

Figure 1A:
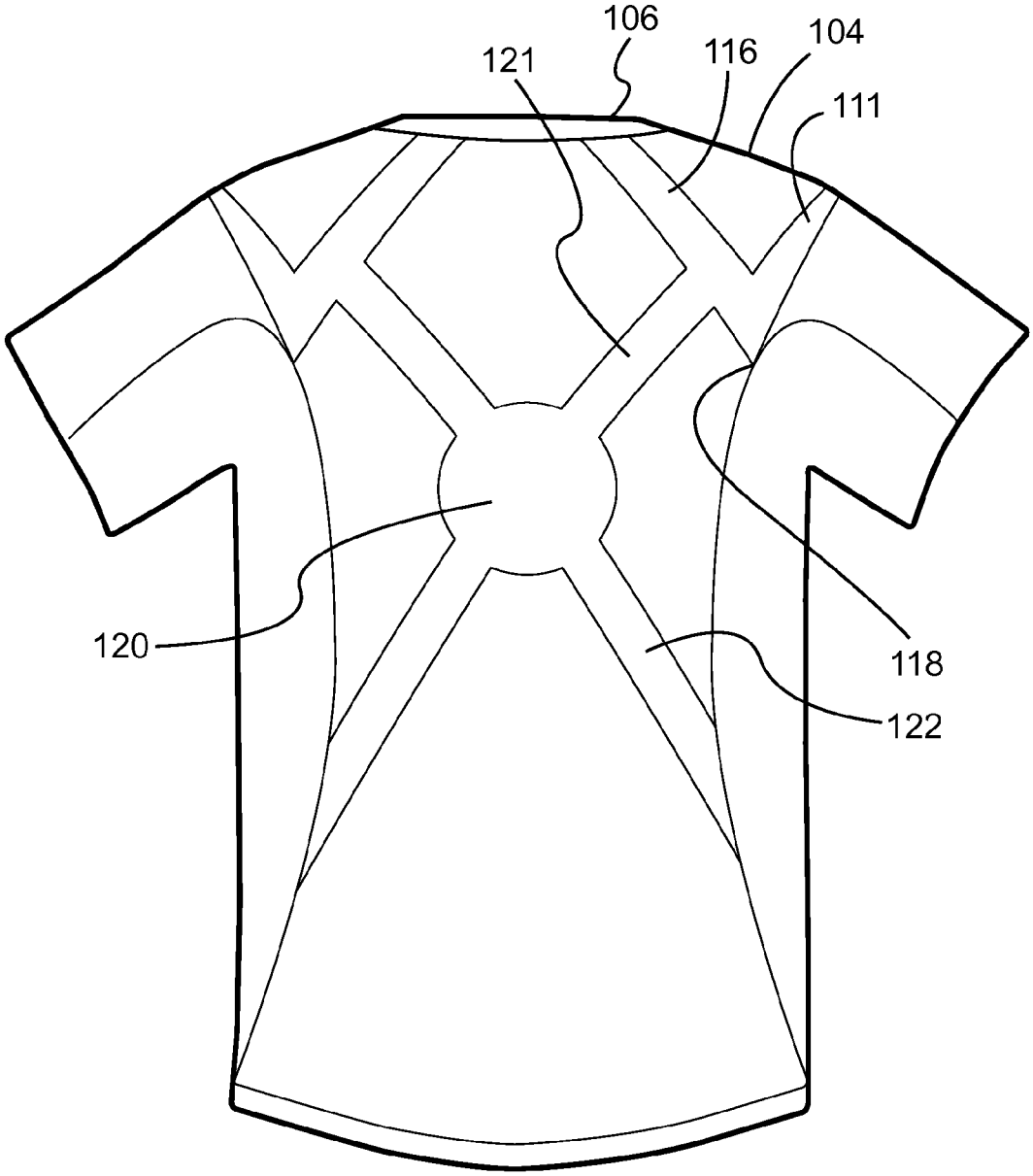
FIG. 1A illustrates a front of a shirt according to one embodiment of this disclosure.
Figure 1B:
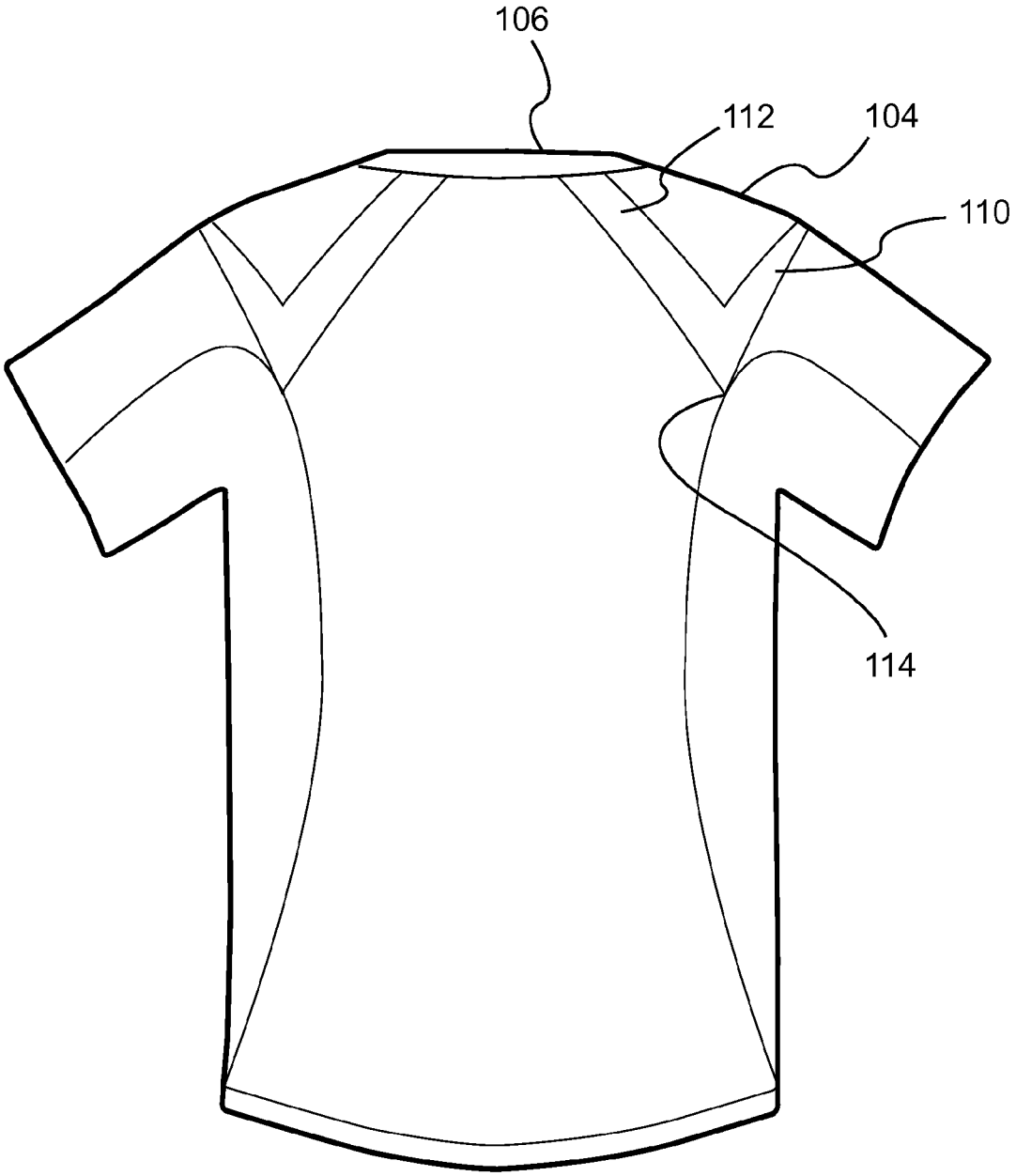
FIG. 1B illustrates a back of the shirt of FIG. 1A.
Figure 2:
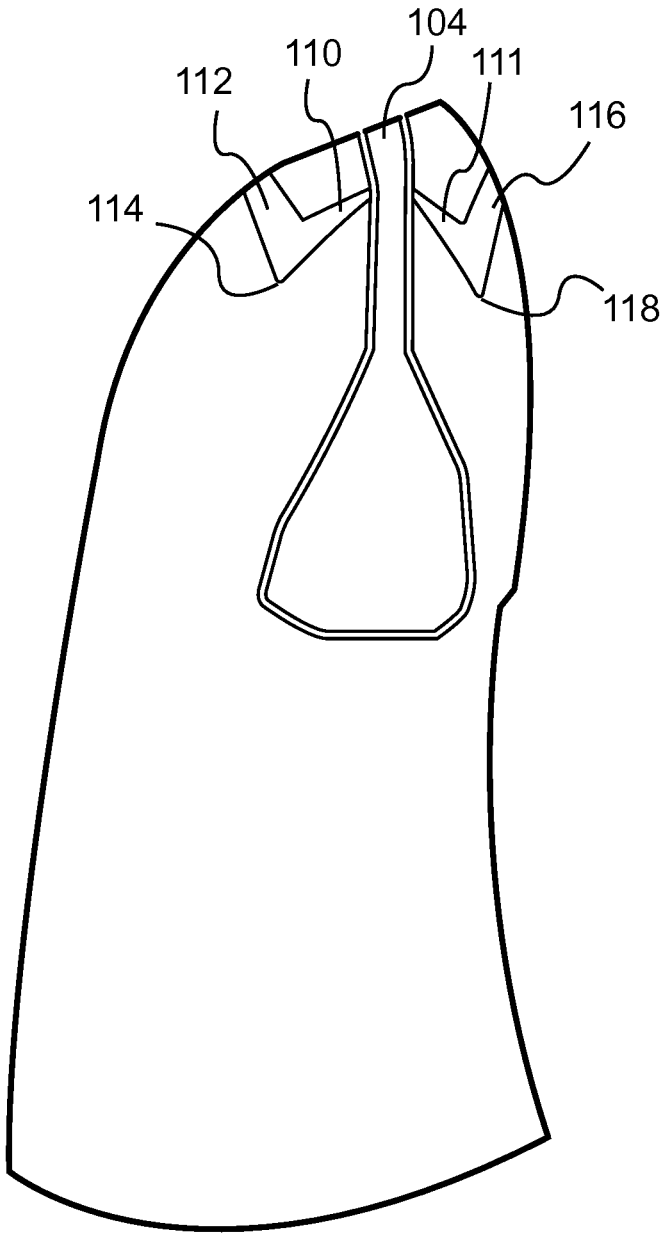

FIG. 2 illustrates a side view of the shirt illustrated in FIG. 1.

Figure 3A:
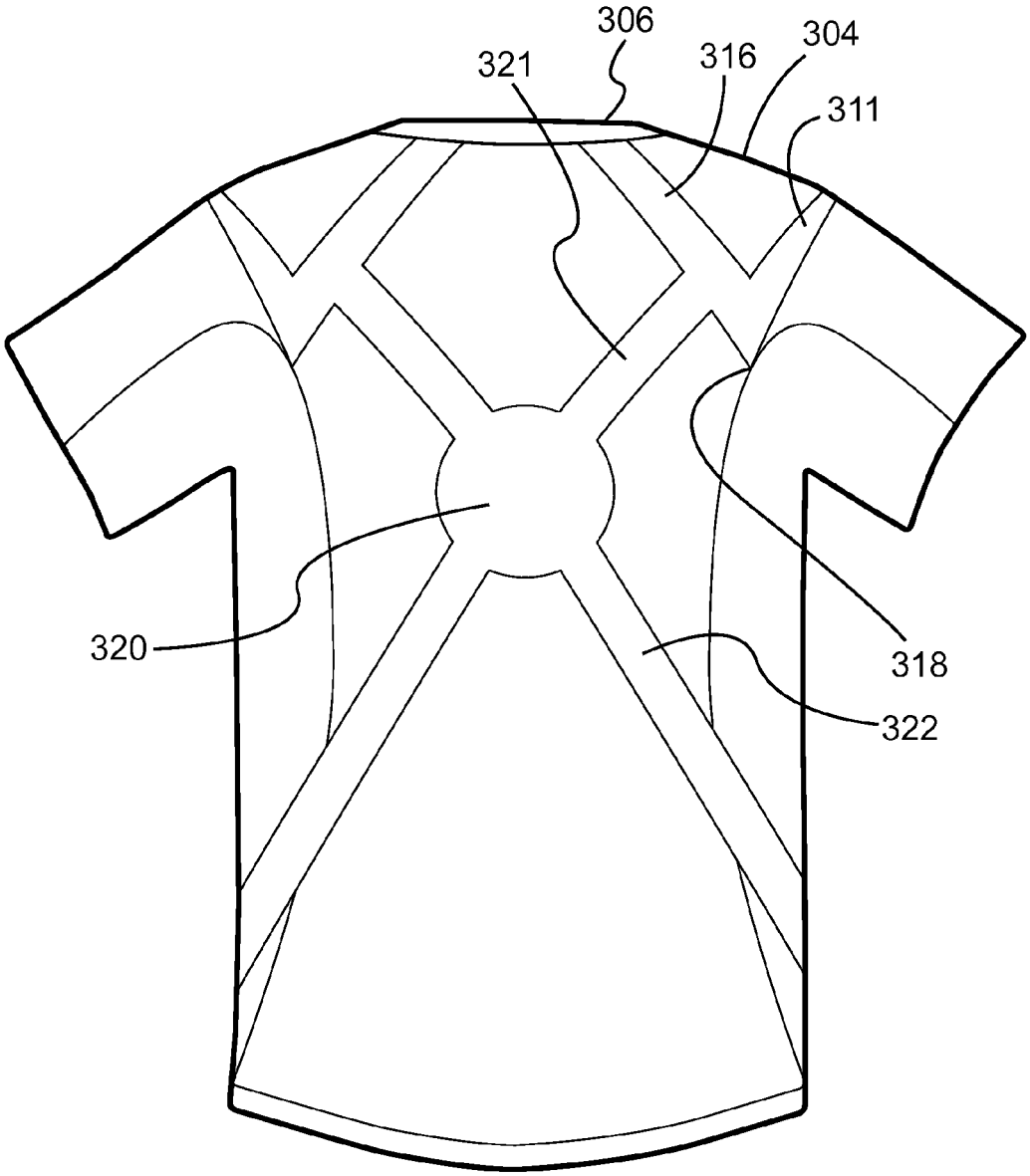

FIG. 3A illustrates a front of a shirt according to another embodiment of this disclosure.

Figure 3B:
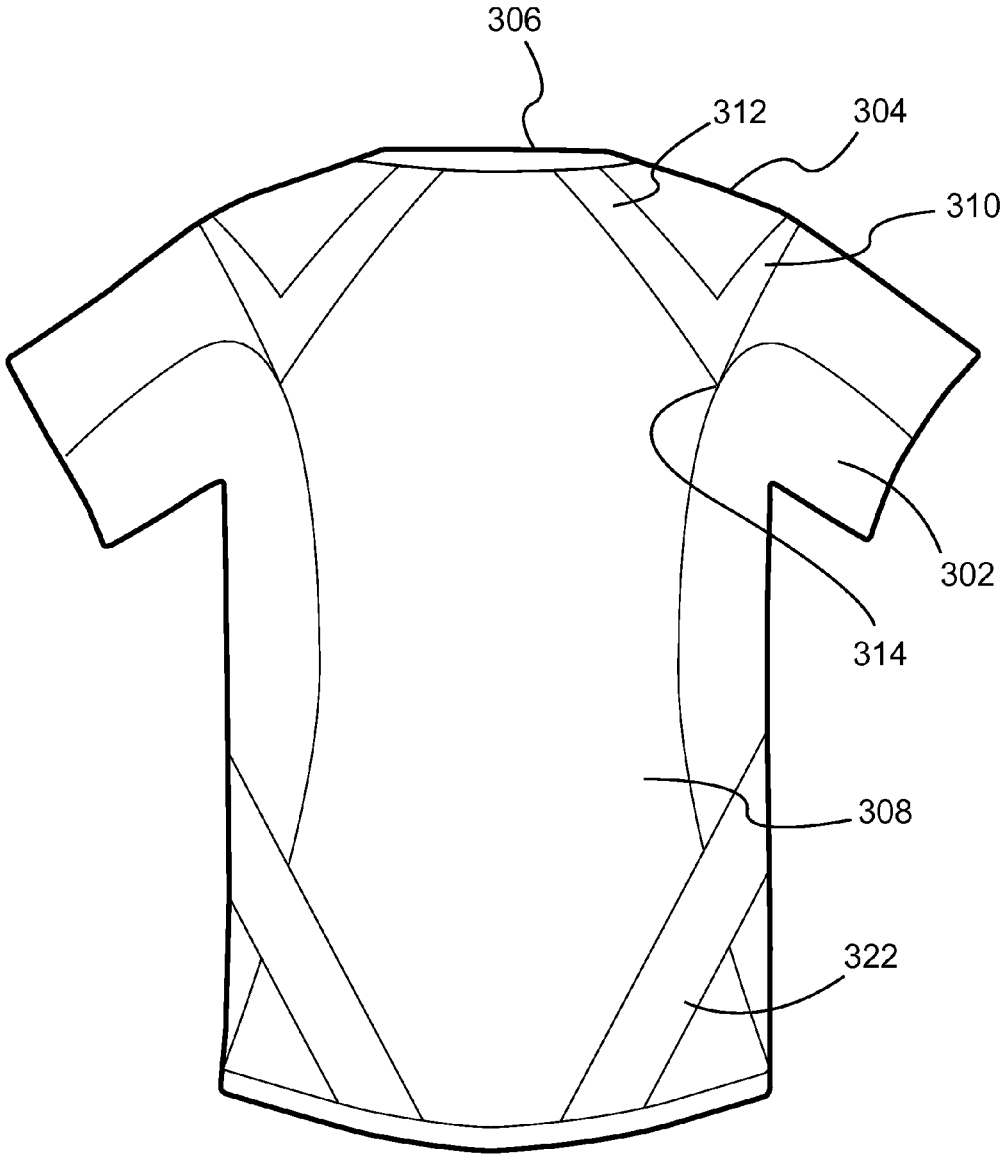

FIG. 3B illustrates a back of the shirt of FIG. 3A.

Figure 4:
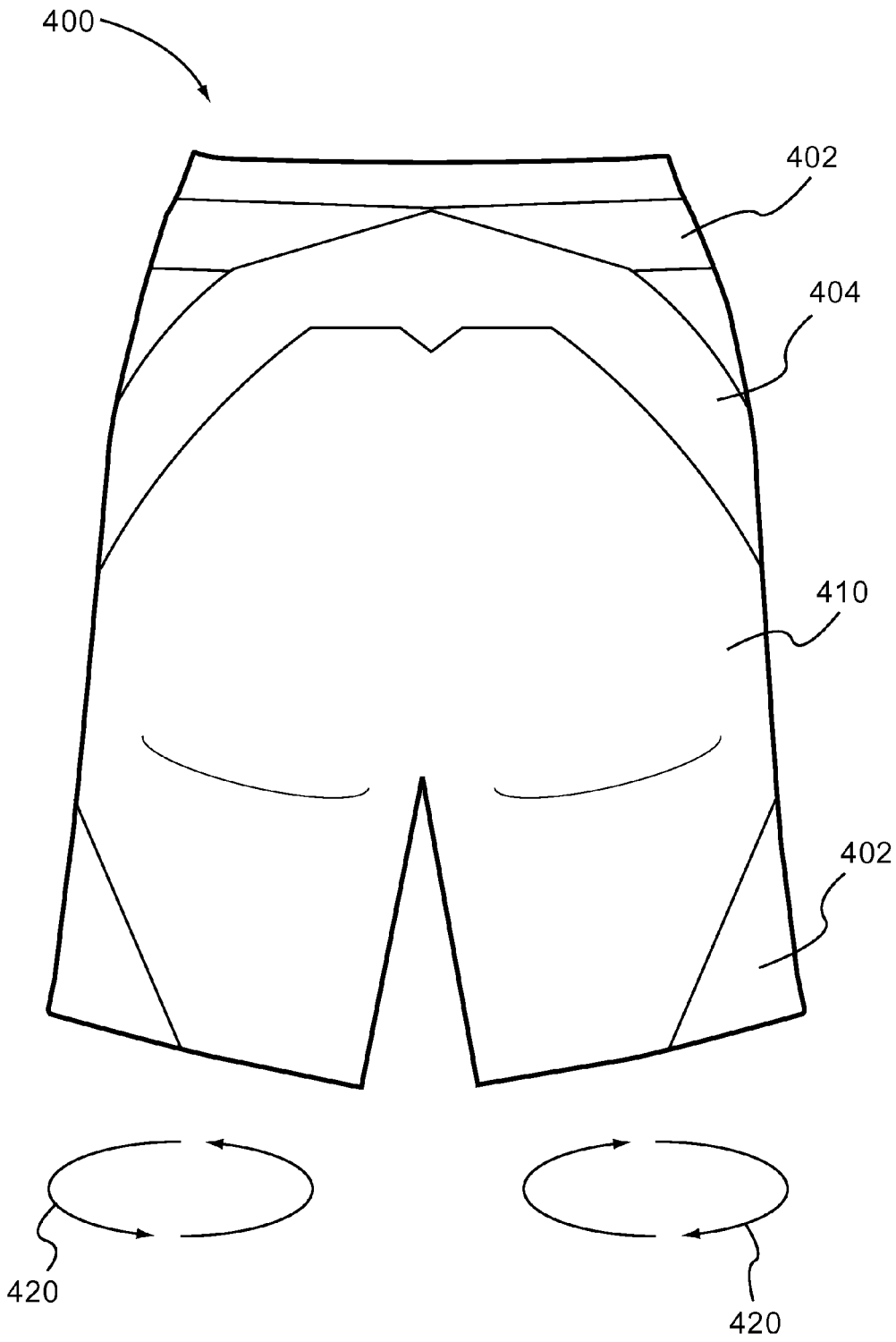

FIG. 4 illustrates a back of a garment in the form of shorts according to one embodiment of this disclosure.

Figure 5:
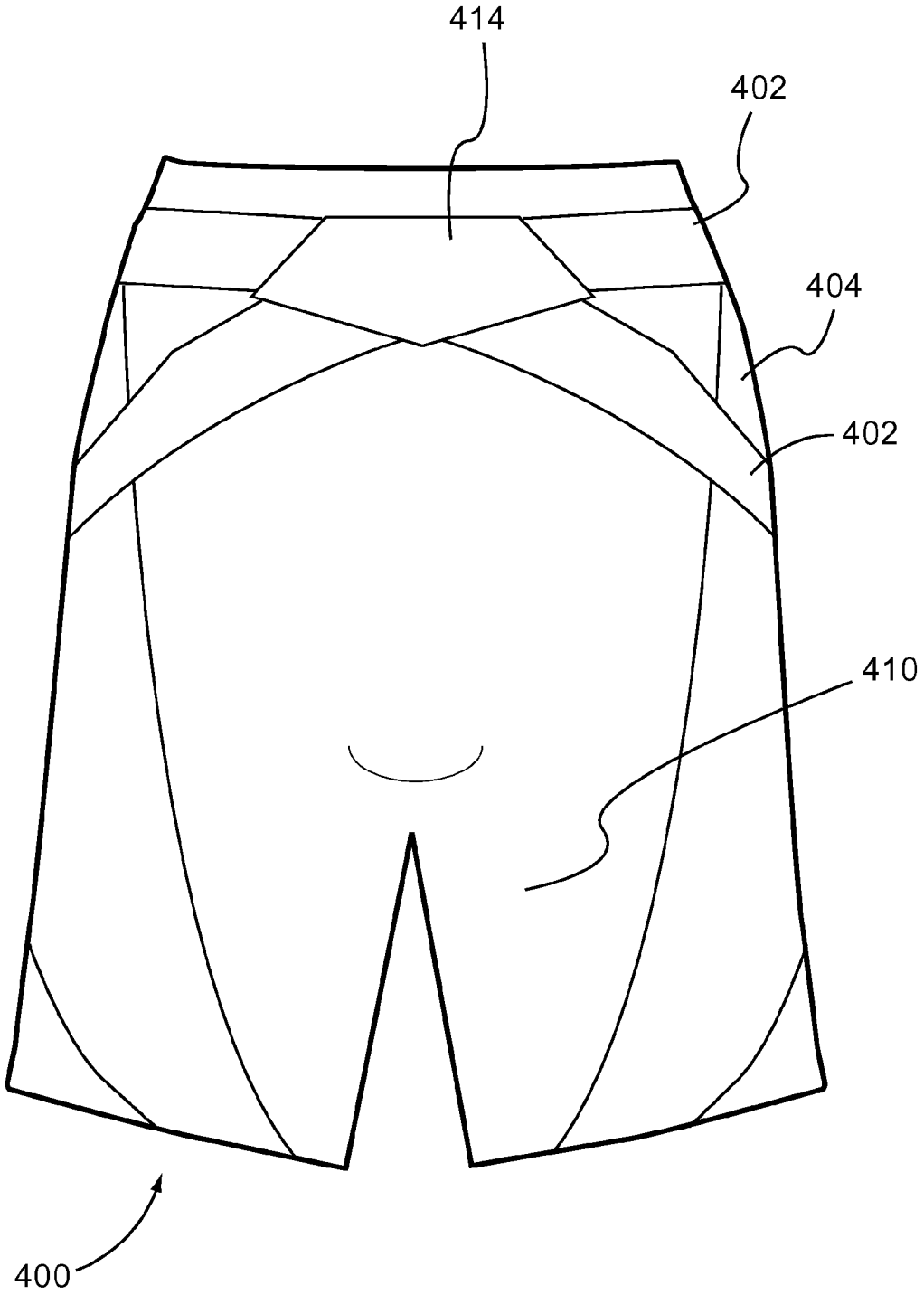

FIG. 5 illustrates a front of the garment of FIG. 4.

Figure 6:
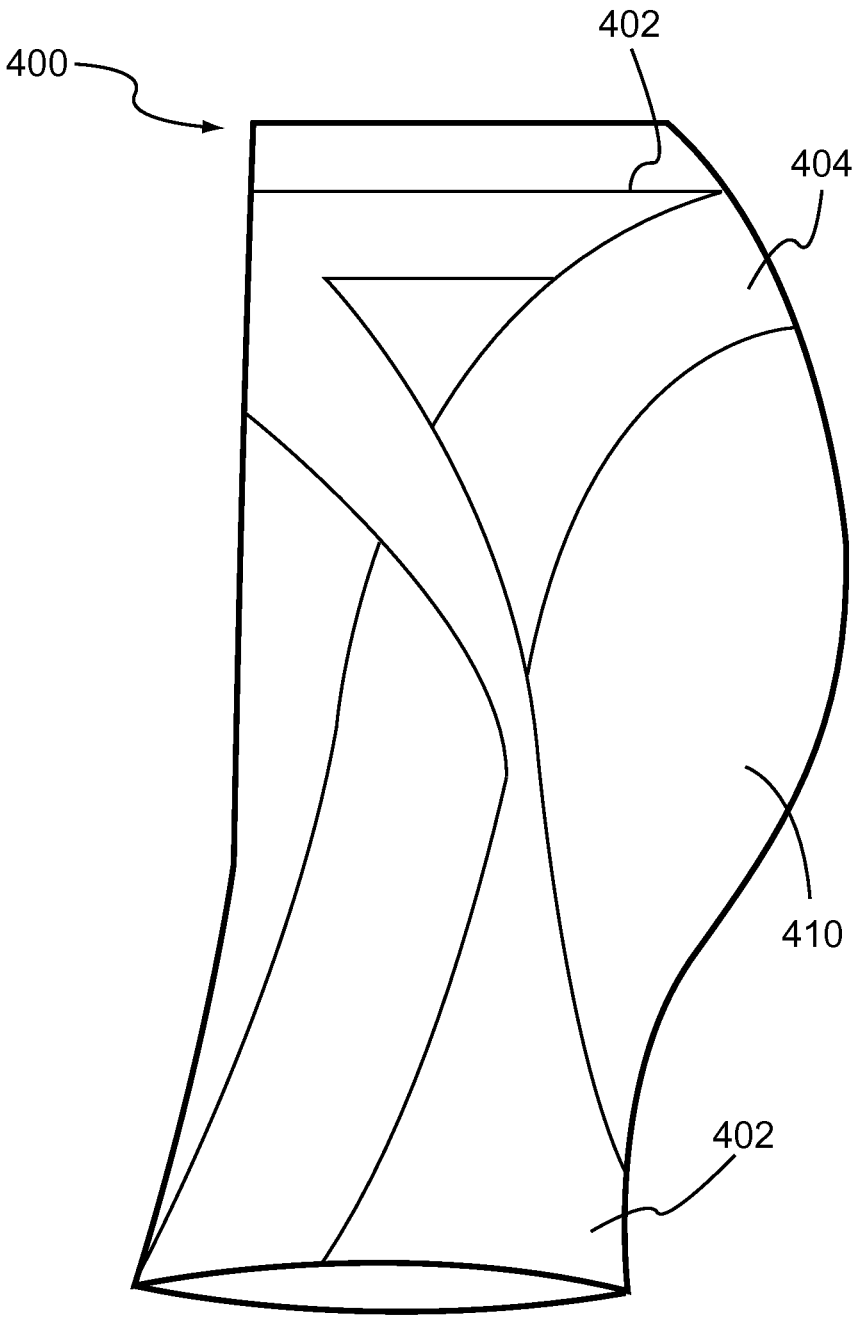

FIG. 6 illustrates a side of the garment of FIG. 4.

Figure 7:
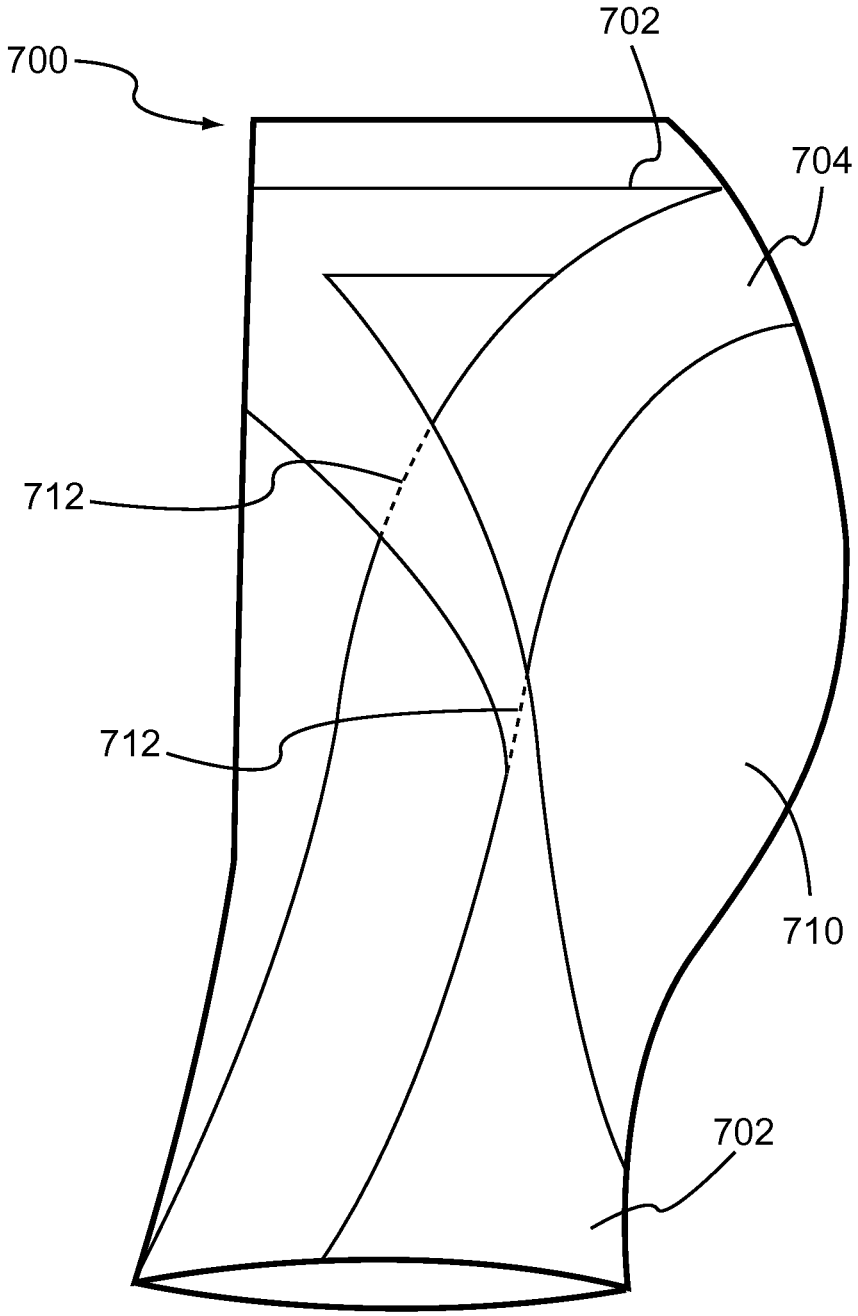

FIG. 7 illustrates a side view of a garment in the form of shorts according to another embodiment of this disclosure.

Figure 8A:
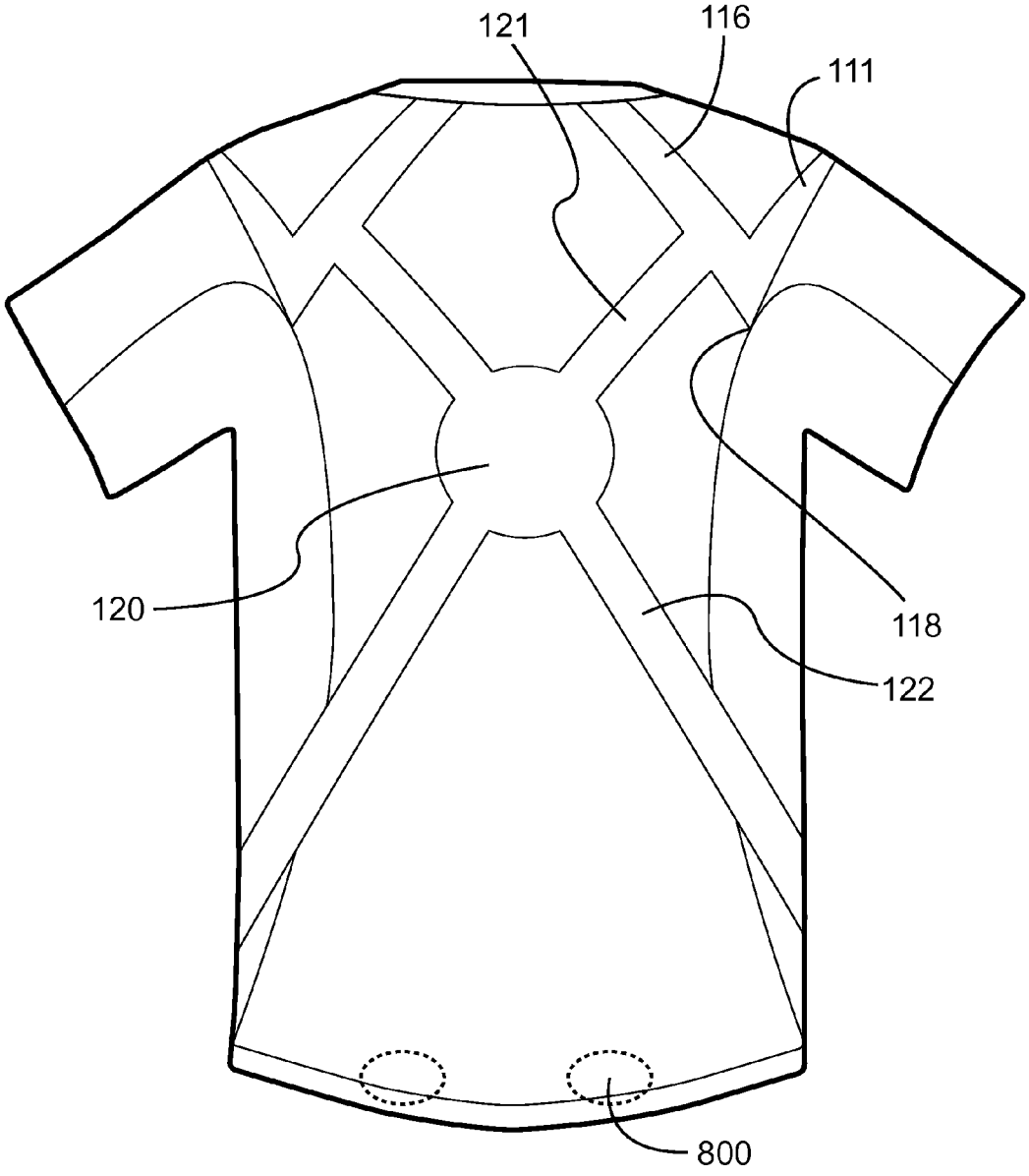

FIG. 8A illustrates a rear view of a garment in the form of a shirt configured to be coupled to a garment in the form of shorts.

Figure 8B:
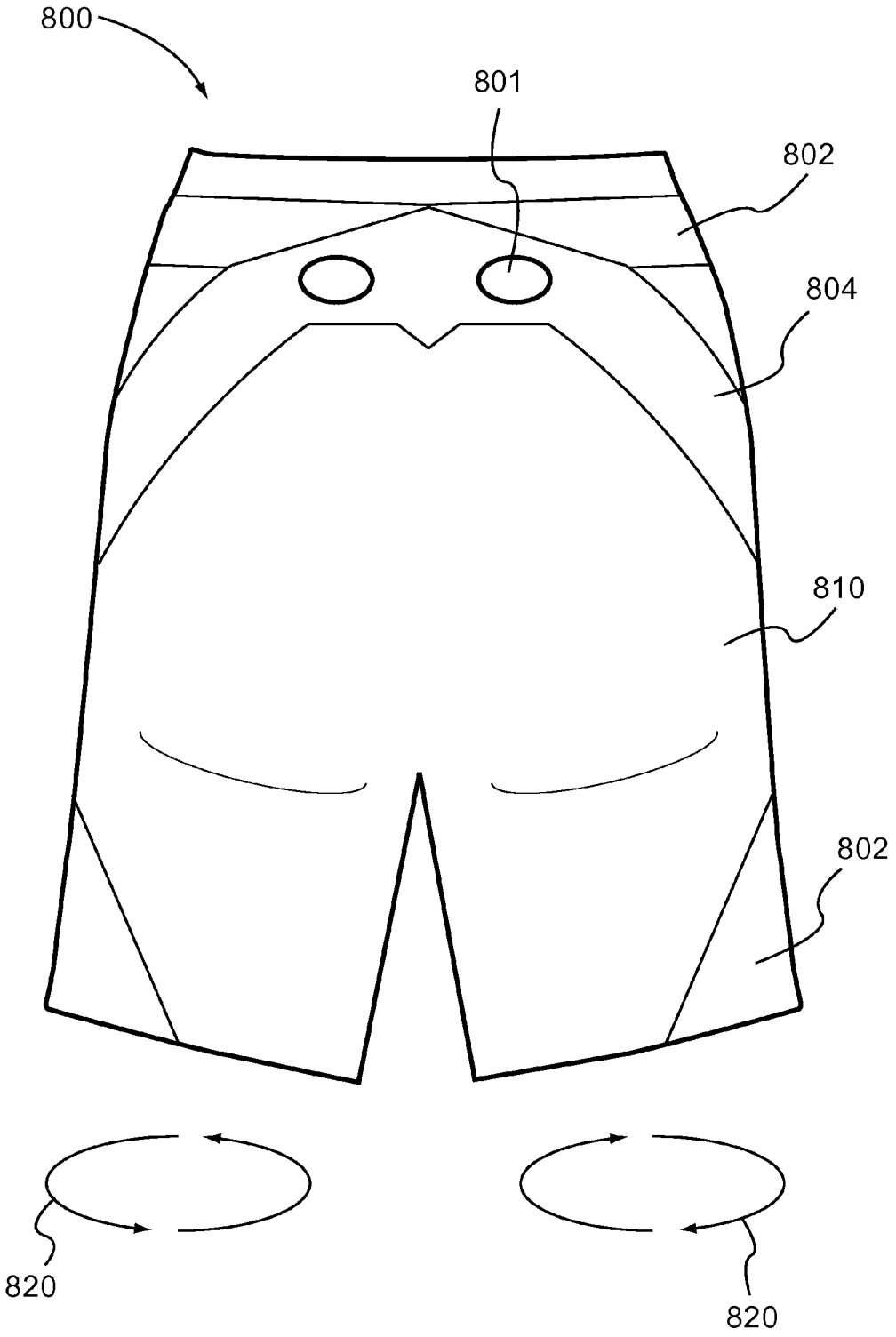

FIG. 8B illustrates a rear view of the garment in the form of shorts that the shirt of FIG. 8A is configured to couple to.

Figure 9:
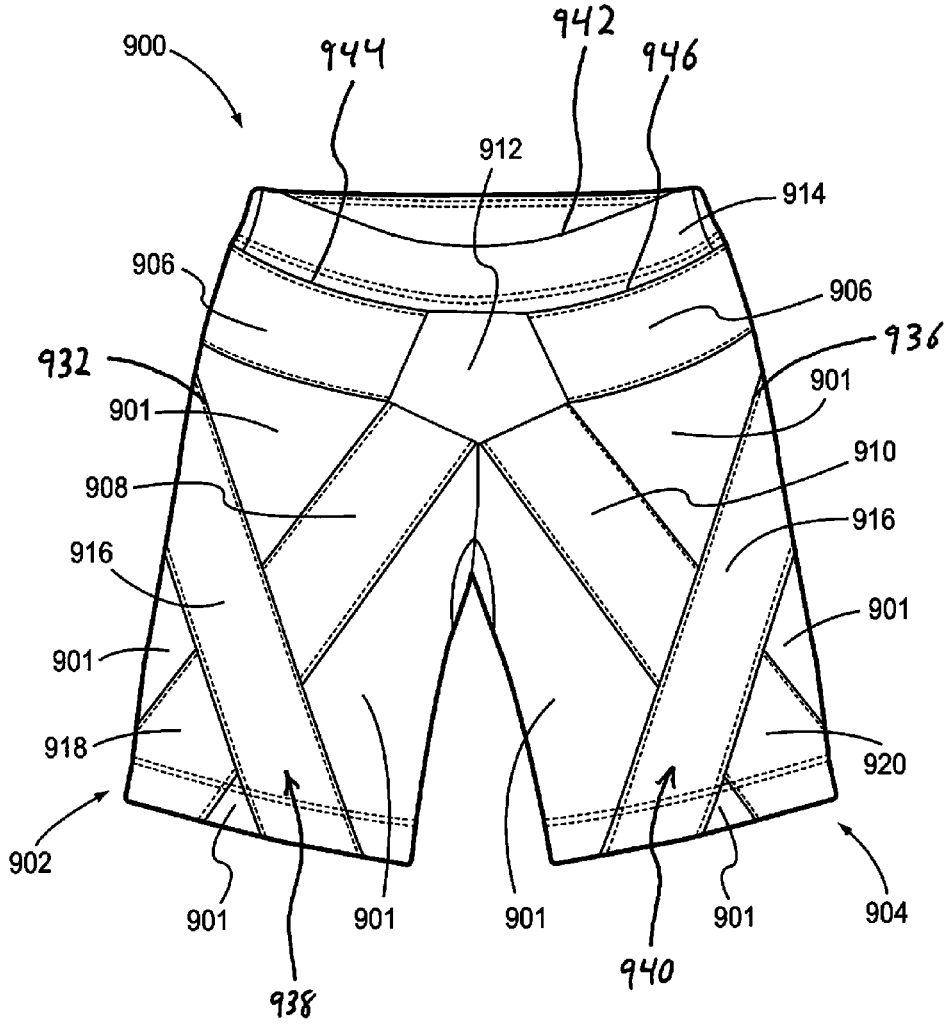

FIG. 9 illustrates a front view of shorts according to one embodiment of this disclosure.

Figure 10:
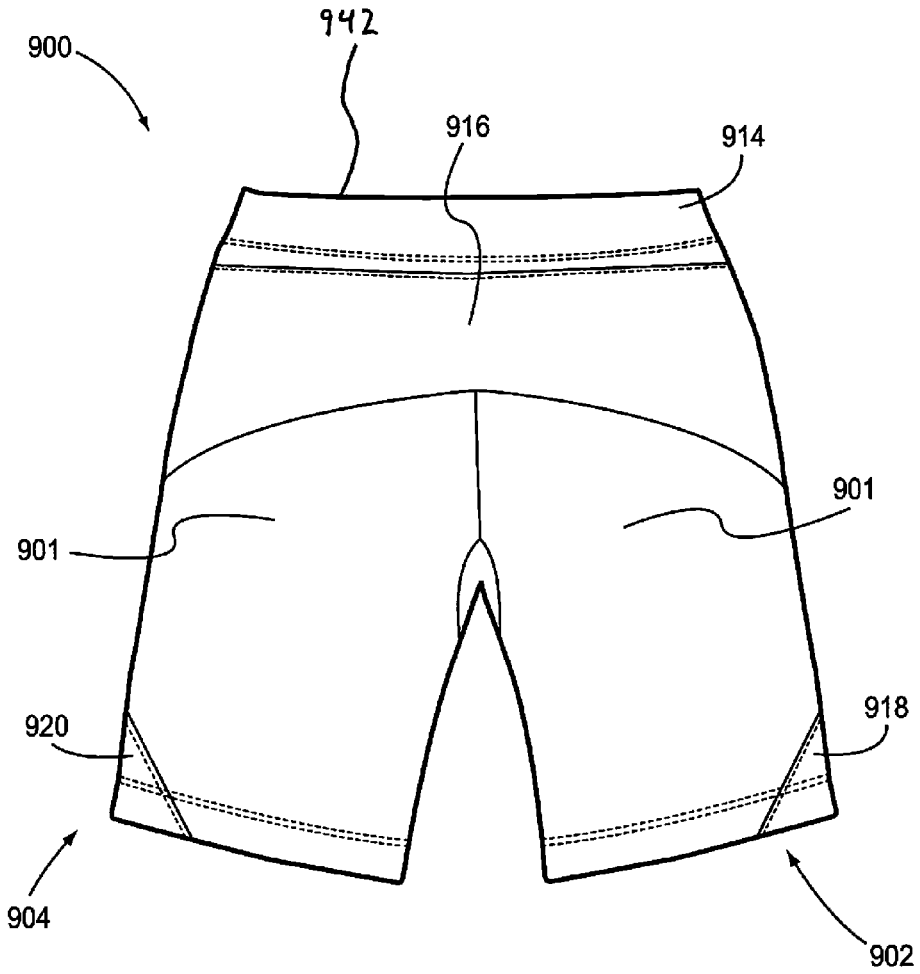

FIG. 10 illustrates a rear view of the shorts of FIG. 9.

Figure 11:
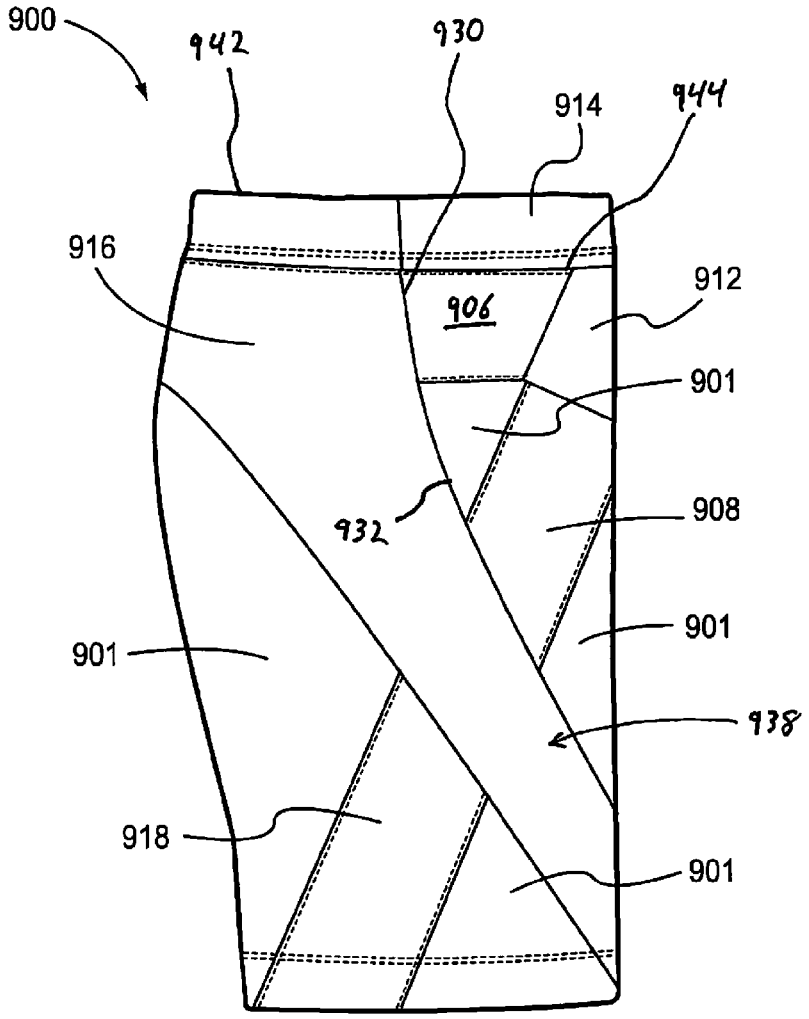

FIG. 11 illustrates a side view of the shorts of FIG. 9.

Figure 12:
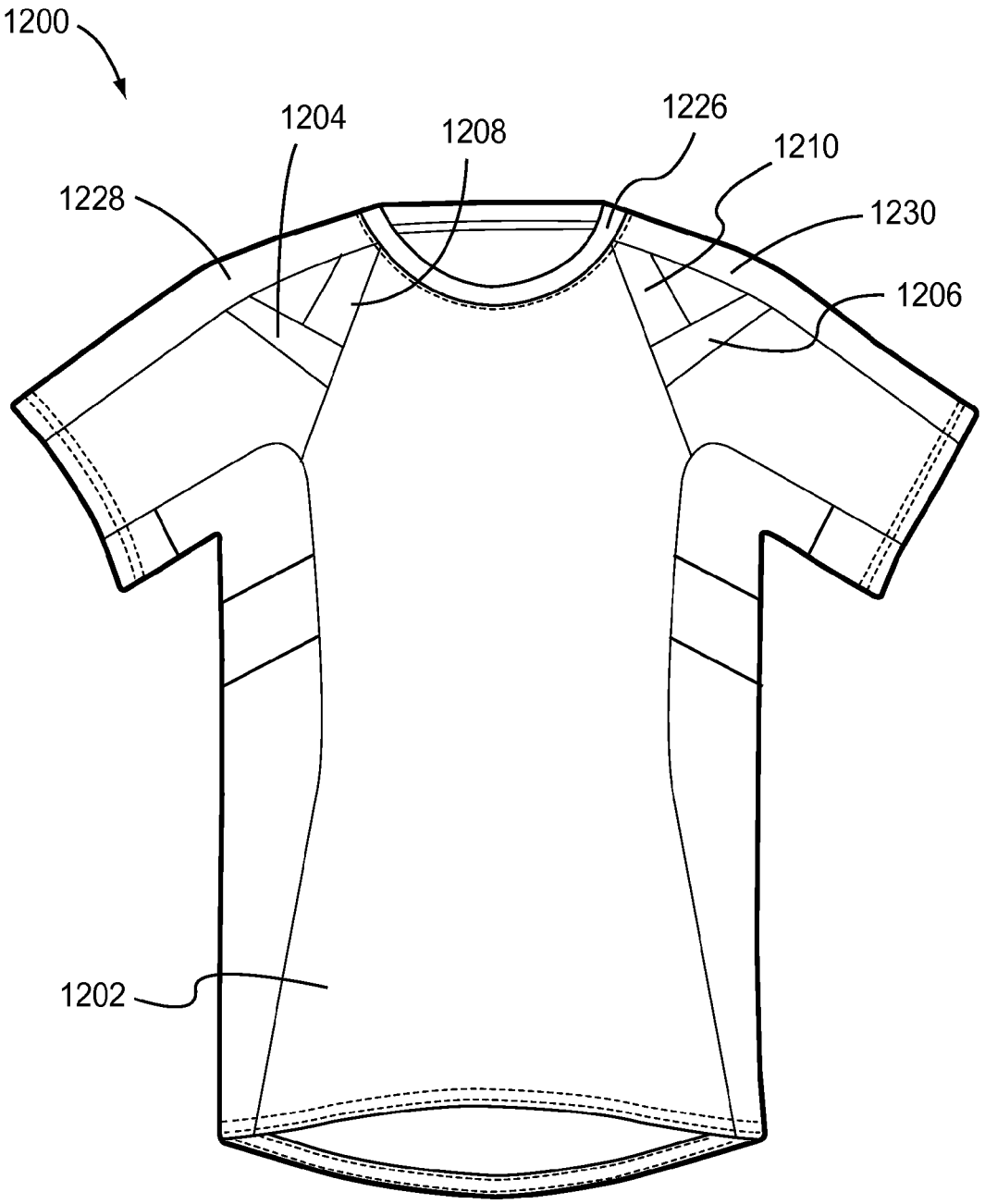

FIG. 12 illustrates a front view of a shirt according to one embodiment of this disclosure.

Figure 13:
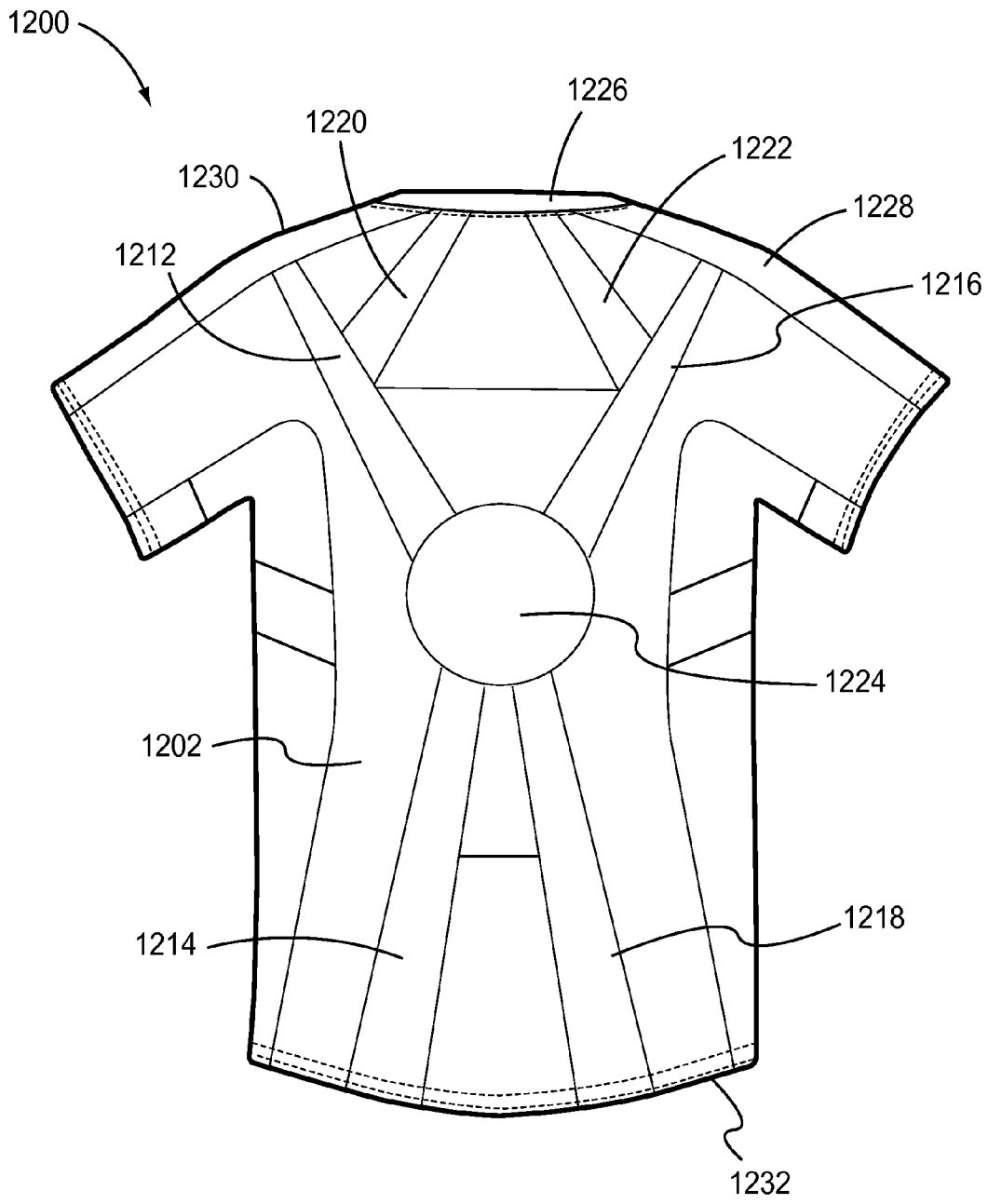

FIG. 13 illustrates a rear view of the shirt of FIG. 12.

DETAILED DESCRIPTION

The present disclosure relates generally to injury prevention and recovery. In particular, but not by way of limitation, the present disclosure relates to systems, methods and apparatuses for clothing that compensates, facilitates or trains weakening or injured muscles.

The word "exemplary" is used herein to mean "serving as an example, instance, or illustration." Any embodiment described herein as "exemplary" is not necessarily to be construed as preferred or advantageous over other embodiments.

The embodiments of the present invention incorporating multiple materials and directions of external tensions are form-fit to the body. These embodiments are not to be confused with compression garments that may be similar in appearance yet only provide a singular, circumferential squeezing force to the body. Scientific testing in the Human Dynamics Laboratory at the University of Denver has demonstrated that an embodiment of the present invention illustrated in one or more of FIGS. 9-11 was superior (95% probability) to a compression garment, known in the art and having similar dimensions, at promoting core stability as well as dynamic landing balance. Dynamic landing balance is a specific functional effect of enhanced core stability.

The gluteus medius muscle links the entire lower extremity with the entire upper extremity and influences the function of the muscular, skeletal and respiratory systems. Therefore external support provided to the gluteus medius muscle during running and/or activities of daily life augmented with postural support of the upper extremity would have a global effect of enhancing dynamic and static postures with a wide range of preventative and/or rehabilitative implications.

FIGS. 1A and 1B illustrate a front and back of a shirt, respectively, according to one embodiment of this disclosure. FIG. 2 illustrates a side view of the shirt showing a left half of the front and back of the shirt. In particular, the shirt includes two types of material (or fabric), one being a 4-way stretch material, which makes up most of the shirt (or an entire layer of the shirt), and a second, being a non-stretch material. A non-stretch material is one that is less-elastic than the 4-way stretch material. The non-stretch material extends in a first band down 112 from a neck 106 of the shirt towards a front corner 114 of the non-stretch material where the first band 112 connects with a second band 110. The second band 110 extends from a front of a shoulder 104 to the front corner 114.

The second band 110 does not cross over the shoulder 104 to the back. Rather a fourth band 111 extends down from a back of the shoulder 104 to a back corner 118 of the non-stretch material. A third band 116 extends down from the neck 106 to the back corner 118 where it connects with the fourth band 111. The back also includes a rear load distribution ring 120 connected to the third band 116 via a first cross-connecting band 121 and connected to a side and lower portion of the torso of the shirt via a second cross-connecting band 122.

While various bands have been described separately, it should be noted that the first and second bands 112, 110 can be a single continuous piece of material in some embodiments and the third band 116, fourth band 111, and first cross-connecting band 121 can be a single continuous piece of material. The second cross-connecting band 122 can also be part of this same single continuous piece of material. In another embodiment, the load distribution ring 120 can also be part of this single continuous piece of material. Alternatively, the load distribution ring 120 can be a separate piece of material that one or more bands connect to, or that is attached to the bands where they intersect, connect, or overlap. For instance, the bands could connect to an outer rim or circumference of the load distribution ring 120. The load distribution ring 120 can also take any of a variety of shapes or configuration of shapes and is not limited to a circular shape. For instance, the load distribution ring 120 could be a configuration of two overlapping shapes each of which could take a shape of an octagon.

The width of the bands does not have a specific value, although it may be desirable for the second and fourth bands 110, 111 to be tapered—being wider near the corners 114, 118 and narrower toward the top of the shoulder 104. The second and fourth bands 110, 111 can be arranged adjacent to a tip of the shoulder at the acromioclavicular joint. In other words, if an imaginary line passed through the tip of the shoulder at the acromioclavicular joint, perpendicular to a frontal plane of the body, the imaginary line would pass through the tapered end of bands 110, 111 near the top of the shoulder 104. In some embodiments, the tapered end of bands 110, 111 can be offset from the imaginary line passing through the tip of the shoulder at the acromioclavicular joint by up to 500 mm.

The load distribution ring 120 can be arranged centrally on the back and with its center vertically positioned over any of the thoracic spinous processes anatomically located between the bottom of the neck and the middle of the back. FIGS. 1 and 3 depict the load distribution ring 120 to be centered over the spinous process near the $6^{th}$ thoracic vertebra.

The non-stretch bands in combination with the 4-way stretch material generate forces configured to mimic muscle function in a user's upper back and shoulders thus assist with proper posture. In particular, the first and second bands 112, 110 in conjunction with the third and fourth bands 116, 111 tension the 4-way stretch fabric across the top of the shoulder 104 and function to "capture" the shoulder. The cross connecting bands 121, 122 and the load distribution ring 120 place a rearward force on the "captured" shoulder and creates a retraction of the clavicle and scapula. This rearward force is directed obliquely through the cross connecting bands 121 and redirected via the load distribution ring 120 to the lower cross connecting band 122 and applies a compressive force on the scapula creating scapular external rotation; scapular upward rotation; and posterior tilting of the scapula.

The non-stretch material can include any material having less elasticity than the 4-way stretch material, although in a preferred embodiment it includes material having no or substantially no elasticity or stretchability. The non-stretch material can be a fabric or other material that does not extend when put under human-induced forces. The 4-way stretch material is a fabric or other material that extends in an elastic manner when put under human-induced forces.

FIG. 2 illustrates a side view of the shirt illustrated in FIG. 1. The first band 112 can be seen to extend down from the neck 106 to the front corner 114 where it connects to the second band 110, which extends down from the front of the shoulder 104. The third band 116 also extends down from the neck 106 to the rear corner 118 where it connects to the fourth band 111, which extends down from the rear of the shoulder 104. As seen, the second and fourth bands 110, 111 do not meet, but leave a gap at the top of the shoulder 104.

The corners 114, 118 can be aligned with or substantially with the glenohumeral joint. In other words, an imaginary line passing through the scapula-arm articulation and perpendicular to a frontal plane of the body would pass through the front corner 114 and the rear corner 118.

For simplicity, other portions of the back of the shirt (e.g., the load distribution ring) are not illustrated.

FIGS. 3A and 3B illustrate a front and a back of a shirt, respectively, according to another embodiment of this disclosure. The shirt again includes a first band 312 extending from a neck 306 to a front corner 314 where the first band 312 intersects with a second band 310, which extends from a front of a shoulder 304 to the front corner 314. The rear of the shirt also has a third band 316 which extends from the neck 306 to a rear corner 318 where it connects to a fourth non-stretch band 311. The fourth non-stretch band 311 extends from a rear of the shoulder 304 to the rear corner 318. A rear load distribution ring 320 connects to the third non-stretch band 316 via a first cross-connecting band 321. The rear load distribution ring 320 also connects to a second cross-connecting band 322. The second cross-connecting band extends down from the rear load distribution ring 320 and wraps around the torso to the front of the shirt where it connects to a bottom front of the shirt.

In some embodiments, the various bands herein described can be combined into longer continuous bands. For instance, the third band 311, fourth band 316, and the first cross-connecting band 321 can be a single continuous band. This band may even cross underneath or through the rear load distribution ring 320 and wrap around the torso and connect to a bottom front of the shirt. Alternatively, all bands on the rear of the shirt can be unified.

In an embodiment, the load distribution ring 320 can be a separate piece of material that the one or more bands connect to, or that is attached to the bands where they intersect, connect, or overlap. For instance, the bands could connect to an outer rim or circumference of the load distribution ring 320. In another embodiment, the load distribution ring 320 can be made from the same piece of material as the various bands on the back of the shirt. The load distribution ring 320 can also take any of a variety of shapes or configuration of shapes and is not limited to a circular shape. For instance, the load distribution ring 320 could be a configuration of two overlapping shapes each of which could take a shape of an octagon.

FIGS. 4-6 illustrate a back, front, and side of shorts 400, respectively, according to one embodiment of this disclosure. The shorts 400 are configured to counteract frontal plane pelvic drop (where one hip is lower than the other when viewed from the front or rear) and internal rotation of the femur (where the pelvis rotates clockwise above the right hip with or without the right femur rotating counter clockwise when viewed from the top), which both can lead to unnecessary loading of a knee. While some systems and methods in the prior art use shorts or pants to counteract bending of the torso in forward and backward directions (rotation in the sagittal plane), the present disclosure goes a step further by also counteracting frontal plane pelvic drop (rotation in the frontal plane) and internal rotation of the femur (inward rotation of the hips in the transverse plane).

The shorts 400 include three different types of material each having a different elasticity. A base layer 410 can be a 4-way stretch material. Bands of two other elasticities can attach to this base layer 410 such that the shorts 400 are multi-layered. A continuous elastic band 402 can be made from a highly elastic material with a more powerful stretch recovery than the base layer material 410 while a continuous non-stretch band 404 can be made from a non-stretch material.

The continuous non-stretch band 404 can start from the sacrum just below the lower back, traverse down a side of the hip with a slight spiral to the front of the leg just over the midline of the leg. The angle of the continuous non-stretch band 404 is somewhat downward or angled toward a bottom of the shorts. This angle and the lack of elasticity of the continuous non-stretch band 404 counteract any tendency that a user has to lean forward at the waist.

A continuous elastic band 402, affixed to the non-stretch band 404 behind the hip, can wrap around the waist just above the hips and intersect or overlap with itself on a front of the shorts at a load distribution ring 414. The continuous elastic band 402 is a highly elastic material with a more powerful stretch recovery than the base layer material 410 and the non-stretch band 404. The continuous elastic band 402 also extends from the load distribution ring 414 obliquely from the pubis and continues down the side of the hip crossing the continuous non-stretch band 404 and connecting laterally to a bottom side and bottom rear of the shorts.

The continuous elastic band 402 and the continuous non-stretch band 404 both connect to the bottom sides of the shorts 400. These two materials, having substantially different elasticities, in close proximity, create a rotation force in the transverse plane for each hip having an inward rotational direction as indicated by arrows 420. In other words, these two materials create a force that rotates the right hip clockwise and the left hip counterclockwise (in the transverse plane), thus counteracting any tendency of the hips to rotate inward. The close proximity of the continuous elastic band 402 and the continuous non-stretch band 404 on the sides of the hips also acts to counteract any frontal plane pelvic drop. In other words, the arrangement of the bands 402, 404 on the side of the hip helps ensure that the hips remain level (in the frontal plane).

The load distribution ring 414 can be arranged at the intersection or overlap point of the two portions of the continuous elastic band 402 to increase the stiffness of the continuous elastic band 402. As the continuous elastic band 402 is stretched during leg and hip movement, the load distribution ring 414 can assist the continuous elastic band 402 in applying pressure to the soft tissues of the lower abdominal area and to distribute tension to the non-stretch band 404 on the sides of the hip. The effect is to provide support to dynamic hip and pelvis rotations.

The load distribution ring 414 is illustrated as a pentagon that is asymmetric in two dimensions. However, the load distribution ring 414 can also be symmetric or can take on other shapes such as a circle, oval, square, hexagon, rectangle, parallelogram, triangle, quadrilateral, rhombus, trapezoid, and many others.

The continuous elastic band 402 crosses over a top of the continuous non-elastic band 404 on both sides of the shorts 400. However, in one embodiment, the two bands 402, 404 can intersect such that they do not overlap, but rather are intertwined. By crossing the continuous elastic band 402 over the continuous non-elastic band 404 the non-elastic band 404 acts as a skeleton or support from which the elastic band 402 can generate tension against when extended. The same skeletal or supporting effect is also provided by the load distribution ring 414. The continuous elastic band 402 extends from the load distribution ring 414, whereas without the load distribution ring 414, the continuous elastic band 402 would extend out of a different reference point or out of a distributed set of reference points, thus causing entirely different forces and tensions to be generated by the continuous elastic band 402.

The shorts can maintain their vertical position via a waistband, tie, or other mechanism at the waist, and by a non-slip elastic leg band circumferentially arranged at a bottom of each leg inside the shorts. The non-slip elastic leg band can wrap around an entire circumference of the inside of each leg of the shorts, or can wrap around only a portion of the circumference. In one embodiment, the non-slip elastic leg band can have two portions, each wrapping around substantially a quarter of the inside circumference of each leg and positioned adjacent to an inside and outside of the leg. The shorts 400 can end approximately 2 to 4 inches above the patella (knee cap).

In one embodiment, the tension of the continuous elastic band 402 is adjustable. For instance, a VELCRO strap, D-ring connector, or some other adjustment means can be used to shorten or lengthen the continuous elastic band 402 relative to the load distribution ring 414. In other words, different portions of the continuous elastic band 402 can be connected to the load distribution ring 414 to increase or decrease the tension of the continuous elastic band 402 just as a belt is shortened or lengthened. This adjustment embodiment allows the shorts 400 to accommodate varying user proportions (e.g., different thigh girths or upper leg circumferences). The adjustments also allow customization of the level of support provided by the shorts 400 to the gluteus medius muscle as well as controlling the amount of gluteal shaping.

A portion of the continuous elastic band 402 can be narrower than other portions of the continuous elastic band 402. For instance, as illustrated, a portion of the continuous elastic band 402 crossing the continuous non-stretch band 404 tapers to a point near a lower rear edge of the continuous non-stretch band 404 before widening again as the continuous elastic band 402 extends to a bottom of the shorts 400.

In an alternative embodiment, rather than attaching the elastic and non-elastic bands (or panels) onto the 4-way stretch material to form a multi-layer article of clothing, the bands can be attached to panels of the 4-way stretch material to form a single-layer article of clothing.

The shorts 400 provide external multidirectional support and variable tensions to the body and reproduce the function of the gluteus medius muscle. An abnormal anatomical relationship between the pelvis and the femur is the primary result of a weak and un-supported gluteus medius muscle. This core instability causes a decrement in athletic performance and clinical symptoms in the spine, hip, knee and ankle. The shorts 400 can be form fitting and include bands (or panels) of various elasticity, and be configured to apply tensions to a wearer's anatomy that assist the function of the gluteus medius muscle in maintaining skeletal alignment, reducing dynamic compensatory or abnormal motions of the spine and leg, decreasing or preventing clinical symptoms, enhancing athletic performance, and promoting gluteal shaping.

FIG. 7 illustrates a side view of shorts 700 according to one embodiment of this disclosure. The shorts 700 include a continuous elastic band 702 and a continuous non-elastic band 704. These bands can be connected to or attached over a four-way stretch material 710. The continuous elastic band 702 can overlap a portion of the continuous non-stretch band 704 near a mid portion of a side of the hip. Stitches 712 (or any other means of affixing one material to another) along an edge of the continuous non-stretch band 704 can also be stitched through the continuous elastic band 702 so as to hold at least a portion of the continuous elastic band 702 in place relative to a portion of the continuous non-stretch band 704.

FIG. 8A illustrates a rear view of a shirt that is connectable to shorts as illustrated in FIG. 8B according to one embodiment of this disclosure. The illustrated shirt and shorts can be connected via connecting mechanisms 800 and 801. The connecting mechanism 800 can be located on an underside of the shirt at the bottom of panel 124 near the waistline. The connecting mechanism 800 can attach to the shorts via connecting mechanism 801 located on a non-stretch panel 804 of the shorts. The connecting mechanisms 800, 801 can be snaps, VELCRO, a D-ring connector, or any other mechanism or material that secures the shirt onto the shorts. While illustrated as being located on a rear of the shirt and shorts, the connecting mechanisms can be located at various other locations including the sides and front of the shirt and shorts. In some embodiments, the connecting mechanisms 800, 801 can be located on two or more of the sides, front, and rear of the shirt and shorts. While two connecting mechanisms 800 and two connecting mechanisms 801 are illustrated, there can also be more or less than the illustrated number of connecting mechanisms 800, 801. For instance, each of the shirt and shorts could have a connecting mechanism on the front, sides, and rear.

FIG. 9 illustrates a front view of shorts according to one embodiment of this disclosure. In one embodiment, the shorts 900 are configured to counteract frontal pelvic plane drop and internal rotation of the femur. The shorts 900 can comprise a base layer 901 having a first elasticity. For the purpose of indicating locations of various elements, the base layer 901 can be split into a left leg portion 902 and a right leg portion 904. A plurality of elastic bands (e.g., 906, 908, 910) can be coupled to or atop the base layer 901, forming a second layer, and can be made from a second material often having the same or a similar elasticity to the first material. In some cases, the second material may be the same as the first material or base layer 901.

The shorts 900 may further include a load distribution ring 912 coupled atop the base layer 901 in a front of the shorts 900 proximate to a front waist portion. In other words, the load distribution ring 912 can be adjacent to or overlap a waist portion 914. The load distribution ring 912 can be coupled to ends of two or more of the plurality of elastic bands 906, 908, 910. For instance, and as illustrated, the load distribution ring 912 is coupled to ends of elastic band 906, an end of elastic band 908, and an end of elastic band 910. The load distribution ring 912 can be made from a third material typically having less elasticity than either the base layer 901 or the second material. The third material can be inelastic or a non-stretch material.

An inelastic band 916 can be coupled atop the base layer 901 and atop portions of at least some of the plurality of elastic bands 906, 908, 910. For instance, and as illustrated in FIGS. 10 and 11, the inelastic band 916 is coupled atop at least a portion of the elastic band 906 in a rear of the shorts 900 proximate to the waist portion 914. This overlap can stretch from a left to a right side of the shorts 900. In particular, the inelastic band 916 overlaps at least a portion of the elastic band 906 proximal a point on the shorts 900 that is configured to be arranged between a sacrum and lower back of a user wearing the shorts. The inelastic band 916 can be shaped so as to have a top edge parallel to the waist region 914 in a rear and possibly sides of the shorts 900, while a lower edge has a concave shape in the rear. The inelastic band 916 can further include a first edge 932 and a second edge 936 and can extend between a first lateral edge 930 of the lateral elastic band 906 and a second lateral edge 934 (not visible) of the lateral elastic band 906. The inelastic band 916 can further include a first extending portion 938 designed to extend from the rear portion of the garment to a front half of the garment and can further include a second extending portion 940 designed to extend from the rear portion of the garment to the front half of the garment. Along the sides and toward the front of the shorts 900 the inelastic band 916 tapers to a strip having a similar width to the elastic bands 906, 908,910.

The inelastic band 916 can further couple to two or more of the plurality of elastic bands 906, 908, 910, for instance the elastic bands 908 and 910 as illustrated. The inelastic band 916 can further intersect a bottom portion, or each leg portion, at a front of the shorts 900. The inelastic band 916 may further traverse down each side of the shorts 900 with a slight spiral to a front of each of the left and right leg portions 920, 918 as seen in FIGS. 9 and 11.

In some cases the inelastic band 916 counteracts a user's tendency to abnormally allow the pelvis to tip forward at the waist. Put another way, the inelastic band 916 provides a structure or skeleton for the shorts 900. In particular, the inelastic band 916 provides regions of the shorts 900 that do not stretch when elastic portions of the shorts 900 are stretched.

The elastic band 906 can be referred to as a lateral elastic band 906 since it wraps around the shorts 906 proximate to the waist portion 914, which can form a top edge 942 of the garment. The lateral elastic band 906 can be discontinuous and have two ends each coupled to a portion of the load distribution ring 912 and have opposing ends to the load distribution ring 912 referred to as a first lateral edge 930 and a second lateral edge 934 (not visible). The lateral elastic band 906 can also have a top edge 944 and a top edge 946. In the illustrated embodiment, where the load distribution ring 912 has two or more edges, the ends of the lateral elastic band 906 can be coupled to two of the sides of the load distribution ring 912. In some embodiments, the load distribution ring 912 is made from the same material as the inelastic band 916 and has the same elasticity as the inelastic band 916. In other embodiments, the load distribution ring 912 is made from a first material and has a first elasticity while the inelastic band 916 is made from a second material and has a second elasticity or is made from the first material but has a second elasticity.

The elastic band 908 can be referred to as a first diagonal elastic band since it can be arranged diagonally and extend at an angle down and away from the load distribution ring 912 on the right leg portion 902 toward a lower edge of the right leg portion 902. Similarly, the elastic band 910 can be referred to as a second diagonal elastic band since it can be arranged diagonally and extend at an angle down and away from the load distribution ring 912 on the left leg portion 904 toward a lower edge of the left leg portion 902.

In some embodiments, an optional second inelastic band 920 and an optional third inelastic band 918 can each be coupled between the inelastic band 916 and a bottom portion of the shorts 900. The bottom portion of the shorts 900 can include a bottom edge of the shorts 900 or a location proximate the bottom edge. In other words, coupling to the bottom edge portion can include coupling to the bottom edge as well as coupling to a point or region that is above the bottom edge. The optional second inelastic band 920 can be arranged on the left leg portion 904 and the optional third inelastic band 918 can be arranged on the right leg portion 902. In one embodiment, the optional second inelastic band 920 is parallel to the elastic band 910, and the optional third inelastic band 918 is parallel to the elastic band 908. This parallel embodiment is best seen in FIG. 11.

For the purposes of this disclosure, "coupled to", "secured to" and "arranged atop" can include any process that fixes one component to another. For instance, sewing or stitching two components together is one means of fixing two components together.

The load distribution ring 912 can take on a variety of shapes, such as a disc, oval, pentagon (as illustrated), or any other shape having a plurality of edges, to name a few. Typical shapes have substantially radial symmetry (e.g., circle, equilateral triangle, square). In one embodiment, the load distribution ring 912 can be arranged proximate to the waist portion 914, meaning that the load distribution ring 912 can be arranged proximate to the waist portion 914 or overlapping the waist portion 914.

The base layer 901 can be made from a first material and have a first elasticity, which may be described as elastic. This first material can be similar to or identical to the 4-way stretch material described in earlier figures. The elastic bands 906, 908, 910 can be made from a second material having a second elasticity, which may also be described as elastic. In some cases, the first and second materials are the same, and thus the base layer 901 and the elastic bands 906, 908, 910 can have the same elasticity. However, the addition of the elastic bands 906, 908, 910 atop the base layer 901 can create regions having a different effective elasticity than areas of the base layer 901 that are not covered by or coupled to an elastic band.

The inelastic bands 916, 918, 920 can be made from a third material having a third elasticity, which can be described as inelastic. The third material can be similar to or the same as the non-stretch material discussed in earlier figures. The third elasticity is typically less elastic than the first and second elasticities. For instance, the third material, in an embodiment, does not substantially stretch when tension is placed on the third material via a user's body.

In some embodiments, the shorts 900 can be made from one or more base layer segments. As illustrated, two segments are used—a left leg portion 902 and a right leg portion 904. However, in other embodiments, a single portion can be use to make the entire shorts 900. In other embodiments, multiple panels or regions can be coupled (e.g., via stitching) to form the shorts 900.

Bands can be straight or curved. They can have parallel edges (e.g., same width along the extent of the band) or they can be tapered at portions (e.g., see FIG. 11).

FIG. 12 illustrates a front of a shirt 1200 according to one embodiment of this disclosure, and FIG. 13 illustrates a back of the shirt 1200 according to one embodiment of this disclosure. The shirt 1200 can be configured to counteract detrimental upper body movements when worn by a user. The shirt can include a base layer 1202 and a plurality of inelastic bands coupled atop the base layer 1202. For instance, a rear of the illustrated shirt 1200 includes first, second, third, and fourth inelastic bands 1216, 1212, 1218, 1214 coupled atop the base layer 1202. The illustrated shirt 1200 further includes fifth and sixth inelastic bands 1222, 1220 coupled to a back of the shirt 1200.

The shirt 1200 further includes a load distribution ring 1224 coupled atop a middle of the back of the shirt 1200. The load distribution ring 1224 anchors ends of at least some of the plurality of inelastic bands. For instance, and as illustrated, the load distribution ring 1224 anchors ends of the first, second, third, and fourth inelastic bands 1216, 1212, 1218, 1214. The front of the shirt 1200 includes seventh, eighth, ninth, and tenth inelastic bands 1204, 1208, 1206, 1210.

The shirt 1200 can include shoulder regions, such as right shoulder region 1228 and left shoulder region 1230. The shoulder regions 1228, 1230 can be devoid of inelastic bands. Further, the first and second inelastic bands 1216, 1212 can couple the right shoulder region 1228 and the left shoulder region 1230, respectively, to the load distribution ring 1224. The first and second inelastic bands 1216, 1212 can be arranged at angles extending outward from the load distribution ring 1224 toward their respective shoulder regions 1228, 1230.

The third and fourth inelastic bands 1218, 1214 can be arranged at angles extending outward from the load distribution ring 1224 toward a bottom region of the back of the shirt 1200. The bottom region can include the bottom edge 1232 or any points proximate the bottom edge 1232. As illustrated, the third and fourth inelastic bands 1218, 1214 extend to the edge 1232.

The shirt 1200 can further include a neck or neck region 1226. The fifth and sixth inelastic bands 1222, 1220 can couple the neck region 1226 to the first and second inelastic bands 1216, 1212, respectively. The fifth and sixth inelastic bands 1222, 1220 can extend down and out from the neck region 1226 toward the first and second inelastic bands 1216, 1212. The fourth and fifth inelastic bands 1222, 1220 can couple to the neck region 1226, or can couple to points proximate the neck region 1226, meaning that they are not required to touch the neck region 1226.

The load distribution ring 1224 can take on a variety of shapes, such as a disc (as illustrated), oval, pentagon, or any other shape having a plurality of edges. Typical shapes have substantially radial symmetry (e.g., circle, equilateral triangle, square). The load distribution ring 1224 is arranged substantially in a middle of the back of the shirt 1200, meaning that the load distribution ring 1224 can be arranged along a vertical axis that separates a back left from a back right portion of the shirt 1200. Substantially in the middle can also mean that the load distribution ring 1224 is equidistant from the neck 1226 and a bottom edge 1232 of the shirt 1200. However, in other embodiments, the load distribution ring 1224 can be somewhat shifted closer to the neck 1226 or closer to the bottom edge 1232.

The seventh inelastic band 1204 couples to, or proximal to, the right shoulder region 1228 at one end. The other end of the seventh inelastic band 1204 couples to a region between the neck region 1226 and a right armpit. The eighth inelastic band 1208 couples the neck region 1208 to the seventh inelastic band 1204 at an angle. For instance, and as illustrated, an angle between the seventh and eighth inelastic bands 1204, 1208 can be substantially a right angle, although other angles are also possible. As illustrated, an end of the eighth inelastic band 1208 couples to a side of the seventh inelastic band 1204. However, in other embodiments, an end of the seventh band 1204 can couple to a side of the eighth inelastic band 1208. Alternatively, both bands can have an angled end such that the angled ends couple to each other much like edges of a picture frame fit together.

All inelastic bands and the load distribution ring 1224 are secured to or coupled atop the base layer 1202 thus forming a single layer or alternatively a second layer of the shirt 1200. Each inelastic band can have parallel edges, or as illustrated, can have tapered edges wherein the width of one end of a band is greater than a width of the other end.

In further embodiments, VELCRO straps, D-ring connectors, or some other adjustment means can be used to shorten or lengthen any of the one or more bands that couple to, or are anchored by, the load distribution ring 912. In other words, different portions of the inelastic band 916 can be connected to the load distribution ring 912 to increase or decrease the tension of the inelastic band 916 just as a belt is shortened or lengthened. Such an embodiment allows the shorts 900 to accommodate varying user proportions (e.g., different thigh girths or upper leg circumferences). The adjustability of any one or more of the bands also allows customization of the level of support provided by the shorts 900 to the gluteus medius muscle as well as control of hip abduction and extension and posterior tipping of the pelvis.

In further embodiments, the various shorts and shirts herein described can be combined into what will be referred to as a one-piece garment. The combination of shorts and a shirt can be made possible via a connecting mechanism such as the connecting mechanisms 800 in FIG. 8A and connecting mechanisms 801 in FIG. 8B. In other embodiments, the shorts and shirt can be manufactured from a single base layer having various inelastic and elastic bands coupled atop the base layer. Alternatively, the shorts and shirt can be manufactured separately and then sewn together at a waist portion 914 of the shorts and a bottom portion of the shirt 1200.

Throughout this disclosure, reference has been made to continuous bands. In some embodiments, these bands need not be continuous. For instance, the continuous elastic band 402 can comprise three different bands that all meet at the load distribution ring 414. The three separate bands can be connected under the load distribution ring 414 or can merely connect to the load distribution ring 414 and otherwise be separated from each other. In further embodiments, VELCRO straps, D-ring connectors, or some other adjustment means can be used to shorten or lengthen any of the one or more bands that couple to, or are anchored by, the load distribution ring 414. In other words, different portions of the continuous elastic band 402 can be connected to the load distribution ring 414 to increase or decrease the tension of the continuous elastic band 402 just as a belt is shortened or lengthened. Such an embodiment allows the shorts 400 to accommodate varying user proportions (e.g., different thigh girths or upper leg circumferences). The adjustability of the three straps also allows customization of the level of support provided by the shorts 400 to the gluteus medius muscle as well as control of hip abduction and extension and posterior tipping of the pelvis.

In conclusion, the present invention provides, among other things, a method, system, and apparatus for clothing that replicates or compensates for a weakened or exhausted gluteus medius. Those skilled in the art can readily recognize that numerous variations and substitutions may be made in the invention, its use, and its configuration to achieve substantially the same results as achieved by the embodiments described herein. Accordingly, the present invention is not intended to be limited to the embodiments shown herein but is to be accorded the widest scope consistent with the principles and novel features disclosed herein.

What is claimed is:

1. A garment configured to counteract frontal pelvic plane drop and internal rotation of the femur, the garment comprising:

a base layer having a right leg portion and a left leg portion, the base layer having a first elasticity;

a load distribution ring arranged proximate to a front waist portion of the garment and having a second elasticity that is less than the first elasticity;

a first lateral elastic band extending from the load distribution ring back toward a rear of the garment in a direction substantially parallel to a top of the garment and secured over the base layer, the first lateral elastic band having a third elasticity, the first lateral elastic band having a first lateral edge;

a second lateral elastic band extending from the load distribution ring back toward the rear of the garment in a direction substantially parallel to the top of the garment and is secured over the base layer, the second lateral elastic band having the third elasticity, the second lateral elastic band having a second lateral edge;

a first diagonal elastic band coupled to and extending at an angle down and away from the load distribution ring on the right leg portion;

a second diagonal elastic band coupled to and extending at an angle down and away from the load distribution ring on the left leg portion; and a first inelastic band, designed to be positioned on at least a rear portion of the garment and having opposite first and second edges, extending between the first lateral edge of the first lateral elastic band and the second lateral edge of the second lateral elastic band via a rear of the garment and having a concave lower edge, the first inelastic band replicating forces otherwise generated by a gluteus medius muscle, and intersecting a bottom portion of each of the leg portions proximate to the front of the garment, the first inelastic band having the second elasticity, the first inelastic band further includes a first extending portion designed to extend from the rear portion of the garment to a front half of the garment on the right leg portion intersecting the first diagonal elastic band, the first inelastic band further includes a second extending portion designed to extend from the rear portion of the garment to the front half of the garment on the left leg portion intersecting the second diagonal elastic band.

2. The garment of claim 1, further comprising:

a second inelastic band coupled between the first inelastic band and a bottom portion of the left leg portion; and a third inelastic band coupled between the first inelastic band and a bottom portion of the right leg portion.

3. The garment of claim 2, wherein the second inelastic band is parallel with the second diagonal elastic band, and the third inelastic band is parallel with a the third diagonal elastic band.

4. The garment of claim 1, wherein the first and third elasticities are the same.

5. The garment of claim 1, wherein the first elasticity is less than the third elasticity.

6. The garment of claim 1, wherein the first inelastic band passes through a point on the garment that is configured to be arranged between a sacrum and lower back of a user wearing the garment.

7. The garment of claim 6, wherein the first inelastic band traverses down each side of the garment with a slight spiral to a front of each of the left and right leg portions.

8. The garment of claim 1, wherein a shape and placement of the first inelastic band counteracts a user's tendency to lean forward at the waist.

9. The garment of claim 1, wherein the load distribution ring is a pentagon.

10. The garment of claim 1, wherein the load distribution ring has a disc shape.

11. The garment of claim 1, wherein the bottom portion of each leg portion is a bottom edge of each leg portion.

12. The garment of claim 1, wherein:

the base layer is a first 4-way stretch fabric;

the load distribution ring and the first inelastic band are a non-stretch material; and the lateral elastic band, the first diagonal elastic band, and the second diagonal elastic band are a second 4-way stretch fabric.

13. The garment of claim 12, wherein the first 4-way stretch fabric and the second 4-way stretch fabric are the same.

14. A garment configured to counteract frontal pelvic plane drop and internal rotation of the femur, the garment comprising:

a base layer having a right leg portion and a left leg portion, the base layer having a first elasticity;

a load distribution ring arranged proximate to a front waist portion of the garment and having a second elasticity that is less than the first elasticity;

a first diagonal elastic band coupled to and extending at an angle down and away from the load distribution ring on the right leg portion;

a second diagonal elastic band coupled to and extending at an angle down and away from the load distribution ring on the left leg portion;

a waist portion wrapping around the entire garment and forming a first top edge of the garment, the waist portion separating the load distribution ring from the top edge of the garment;

a first lateral elastic band extending toward a rear of the garment and having a second top edge proximal to the waist portion, the first lateral elastic band having a first lateral edge;

a second lateral elastic band extending toward the rear of the garment and having a third top edge proximal to the waist portion, the second lateral elastic band having a second lateral edge; and a first inelastic band, designed to be positioned on at least the rear portion of the garment and having opposite first and second edges, extending between the first lateral edge of the first lateral elastic band and the second lateral edge of the second lateral elastic band via the rear of the garment, and having a concave lower edge and a straight top edge across at least a portion and sides of the garment, the first inelastic band intersecting a bottom portion of each of the leg portions proximate to the front of the garment, the first inelastic band having the second elasticity, the first inelastic band further includes a first extending portion designed to extend from the rear of the garment to a front half of the garment on the right leg portion and intersect the first diagonal elastic band;

the first inelastic band further includes a second extending portion designed to extend from the rear of the garment to the front half of the garment on the left leg portion and intersect the second diagonal elastic band.

15. A garment configured to counteract frontal pelvic plane drop and internal rotation of the femur, the garment comprising:

a base layer having a right leg portion and a left leg portion, the base layer having a first elasticity;

a load distribution ring arranged proximate to a front waist portion of the garment and having a second elasticity that is less than the first elasticity;

a first diagonal elastic band coupled to and extending at an angle down and away from the load distribution ring on the right leg portion;

a second diagonal elastic band coupled to and extending at an angle down and away from the load distribution ring on the left leg portion;

a first lateral elastic band extending rearward from the load distribution ring around a right side of the garment, the first lateral elastic band having a first lateral edge;

a second lateral elastic band extending rearward from the load distribution ring around a left side of the garment, the second lateral elastic band having a second lateral edge;

a first inelastic band, designed to be positioned on at least a rear portion of the garment and having opposite first and second edges, extending between the first lateral edge of the first lateral elastic band and the second lateral edge of the second lateral elastic band via a rear of the garment and having a concave lower edge and a top edge parallel to a top edge of the garment in a rear and at least a portion of sides of the garment, the first inelastic band tapering as it spirals around each of the leg portions to intersect a bottom portion of each of the leg portions proximate to the front of the garment, the first inelastic band having the second elasticity, the first inelastic band further includes a first extending portion designed to extend from the rear of the garment to a front half of the garment on the right leg portion and intersect the first diagonal elastic band; and the first inelastic band further includes a second extending portion designed to extend from the rear of the garment to the front half of the garment on the left leg portion and intersect the second diagonal elastic band.

16. The garment of claim 1, wherein a rear edge of the first diagonal elastic band and a rear edge of the second diagonal elastic band intersect a bottom edge of the first inelastic band within a front half of the garment.

17. The garment of claim 16, wherein the rear edge of the first diagonal elastic band and the rear edge of the second diagonal elastic band intersect the first inelastic band forward of a trochanter major of a user when the garment is worn, regardless of a size or shape of the user and regardless as to how the garment is worn.

18. The garment of claim 1, wherein a rear edge of the first diagonal elastic band and a rear edge of the second diagonal elastic band intersect the first inelastic band within a front half of the garment.

19. The garment of claim 1, wherein the first diagonal elastic band and the second diagonal elastic band intersect the first inelastic band forward of a trochanter major of a user when the garment is properly worn, and wherein the user wears a properly-sized garment.

20. The garment of claim 1, wherein the first diagonal elastic band and the second diagonal elastic band intersect the first inelastic band proximal to a front of the garment.

21. The garment of claim 1, wherein the first and second lateral elastic bands have top edges, where an entire span of the top edges of the first and second lateral elastic bands are parallel to a top edge of the garment.

22. The garment of claim 1, wherein the first inelastic band partially overlaps and is neither perpendicular nor parallel to muscle fibers of a gluteus medius.

23. The garment of claim 1, wherein a top edge of the first and second lateral elastic bands as well as a top edge of the first inelastic band form a continuous edge that is parallel to, but does not touch, a top edge of the garment.

* * * * *